US009146487B2

(12) United States Patent
Sawada et al.

(10) Patent No.: US 9,146,487 B2
(45) Date of Patent: Sep. 29, 2015

(54) CARRIER FOR DEVELOPING ELECTROSTATIC LATENT IMAGE, AND ELECTROSTATIC LATENT IMAGE DEVELOPER

(71) Applicants: Toyoshi Sawada, Kanagawa (JP); Shigenori Yaguchi, Shizuoka (JP); Hiroshi Tohmatsu, Shizuoka (JP); Hitoshi Iwatsuki, Shizuoka (JP); Toyoaki Tano, Shizuoka (JP); Hiroyuki Kishida, Shizuoka (JP); Yumiko Yagi, Shizuoka (JP)

(72) Inventors: Toyoshi Sawada, Kanagawa (JP); Shigenori Yaguchi, Shizuoka (JP); Hiroshi Tohmatsu, Shizuoka (JP); Hitoshi Iwatsuki, Shizuoka (JP); Toyoaki Tano, Shizuoka (JP); Hiroyuki Kishida, Shizuoka (JP); Yumiko Yagi, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/932,368

(22) Filed: Jul. 1, 2013

(65) Prior Publication Data

US 2014/0023966 A1 Jan. 23, 2014

(30) Foreign Application Priority Data

Jul. 20, 2012 (JP) ..... 2012-161331

(51) Int. Cl.
*G03G 9/113* (2006.01)

(52) U.S. Cl.
CPC ..... *G03G 9/1136* (2013.01); *G03G 9/1131* (2013.01); *G03G 9/1133* (2013.01); *G03G 9/1139* (2013.01)

(58) Field of Classification Search
CPC ..... G03G 9/1136; G03G 9/1139
USPC ..... 430/111.1, 111.35, 111.32
See application file for complete search history.

(56) References Cited

U.S. PATENT DOCUMENTS

| | | | | | |
|---|---|---|---|---|---|
| 5,093,201 | A | * | 3/1992 | Ohtani et al. | 430/111.35 |
| 5,427,884 | A | * | 6/1995 | Ohtani et al. | 430/108.14 |
| 5,731,120 | A | * | 3/1998 | Tanigami et al. | 430/111.35 |
| 6,124,066 | A | * | 9/2000 | Kim et al. | 430/111.32 |

(Continued)

FOREIGN PATENT DOCUMENTS

| | | |
|---|---|---|
| JP | 7-072733 | 3/1995 |
| JP | 7-092813 | 4/1995 |

(Continued)

OTHER PUBLICATIONS

Carl Zeiss Ultra Series Field Emission Scanning Electron Microscope: http://www.zeiss.com/microscopy/en_us/products/scanning-electron-microscopes/ultra-materials.html; retrieved Jul. 28, 2014.*

(Continued)

*Primary Examiner* — Christopher Rodee
(74) *Attorney, Agent, or Firm* — Oblon, McClelland, Maier & Neustadt, L.L.P.

(57) ABSTRACT

A carrier for developing electrostatic latent images includes a core material; and a covering layer formed of a resin comprising an electroconductive particulate material, overlying the core material, wherein the covering layer includes the electroconductive particulate material in an amount of from 58 to 73% by weight and has a resistivity of from 6.6 to 8.6 Ωcm, and wherein the carrier has a high-brightness contrast part at an areal ratio less than 1% and 40 to 90% based on total area thereof at an acceleration voltage of 0.8 KV and 2.0 KV, respectively in an FE-SEM reflection electron image of the surface thereof.

8 Claims, 6 Drawing Sheets

| ACCELERATION VOLTAGE | AREA RATIO OF HIGH BRIGHTNESS CONTRAST PART |
|---|---|
| 0.8kV | LESS THAN 1% |
| 2kV | 40 - 90% |

(56) References Cited

U.S. PATENT DOCUMENTS

| | | | | |
|---|---|---|---|---|
| 6,235,443 | B1 * | 5/2001 | Kayamoto et al. | 430/111.1 |
| 8,512,929 | B2 * | 8/2013 | Iwatsuki et al. | 430/111.35 |
| 8,652,738 | B2 * | 2/2014 | Yamaguchi et al. | 430/111.35 |
| 2006/0024606 | A1 * | 2/2006 | Suzuki et al. | 430/111.35 |
| 2007/0015078 | A1 * | 1/2007 | Suzuki et al. | 430/111.35 |
| 2008/0171274 | A1 * | 7/2008 | Yagi et al. | 430/109.3 |
| 2010/0068645 | A1 | 3/2010 | Iwatsuki et al. | |
| 2010/0233613 | A1 * | 9/2010 | Masuda et al. | 430/111.1 |
| 2011/0081608 | A1 | 4/2011 | Yaguchi et al. | |
| 2011/0091802 | A1 | 4/2011 | Takahashi et al. | |
| 2011/0171573 | A1 * | 7/2011 | Sakata et al. | 430/111.1 |
| 2012/0058423 | A1 * | 3/2012 | Yamaguchi et al. | 430/105 |
| 2013/0065171 | A1 * | 3/2013 | Yaguchi et al. | 430/111.3 |
| 2013/0065175 | A1 | 3/2013 | Sakata et al. | |
| 2013/0101930 | A1 | 4/2013 | Yamaguchi et al. | |
| 2013/0252169 | A1 * | 9/2013 | Yaguchi et al. | 430/111.35 |

FOREIGN PATENT DOCUMENTS

| | | |
|---|---|---|
| JP | 7-128983 | 5/1995 |
| JP | 7-234548 | 9/1995 |
| JP | 9-251237 | 9/1997 |
| JP | 10-055113 | 2/1998 |
| JP | 10-301337 | 11/1998 |
| JP | 11-065247 | 3/1999 |
| JP | 11-202560 | 7/1999 |
| JP | 11-231652 | 8/1999 |
| JP | 2002-296898 | 10/2002 |
| JP | 2005-157002 | 6/2005 |
| JP | 2005-274805 | 10/2005 |
| JP | 2006-038961 | 2/2006 |
| JP | 2007-286092 | 11/2007 |
| JP | 2007-333886 | 12/2007 |
| JP | 2008-040270 | 2/2008 |
| JP | 2008-083098 | 4/2008 |
| JP | 2009-069377 | 4/2009 |
| JP | 2009-093053 | 4/2009 |

OTHER PUBLICATIONS

Technical Support for Media Cybernetics Products: http://support.mediacy.com/answers/showquestion.asp?faq=35&fIdAuto=234; retrieved Jul. 29, 2014.*

* cited by examiner

| ACCELERATION VOLTAGE | AREA RATIO OF HIGH BRIGHTNESS CONTRAST PART |
|---|---|
| 0.8kV | LESS THAN 1% |
| 2kV | 40 - 90% |

| ACCELERATION VOLTAGE | AREA RATIO OF HIGH BRIGHTNESS CONTRAST PART |
|---|---|
| 0.8kV | LESS THAN 1% |
| 2kV | LESS THAN 40% |

| ACCELERATION VOLTAGE | AREA RATIO OF HIGH BRIGHTNESS CONTRAST PART | |
|---|---|---|
| 0.8kV | 1% OR MORE | 1% OR MORE |
| 2kV | 90% OR MORE | 40% - 90% |

CARRIER FOR DEVELOPING ELECTROSTATIC LATENT IMAGE, AND ELECTROSTATIC LATENT IMAGE DEVELOPER

CROSS-REFERENCE TO RELATED APPLICATIONS

This patent application is based on and claims priority pursuant to 35 U.S.C. §119 to Japanese Patent Application No. 2012-161331, filed on Jul. 20, 2012, in the Japan Patent Office, the entire disclosure of which is hereby incorporated by reference herein.

BACKGROUND

1. Technical Field

The present invention relates to a carrier for developing electrostatic latent images, used in electrophotographic methods and electrostatic recordings, and an electrostatic latent image developer using the carrier, a color toner developer, a developer for supply, an image forming method, a process cartridge including the electrostatic latent image developer and an image forming apparatus.

2. Description of the Related Art

In electrophotographic image formation, an electrostatic latent image is formed on an image bearer such as a photoconductive material, charged toner particles are transferred onto the electrostatic latent image to form a toner image, the toner image is transferred onto a recording paper such as a paper, and the toner image is fixed thereon to form a printed image. Conventionally, a one-component developing method, a two-component developing method and a hybrid developing methods are used. In order to produce uniform and clear full-color images having good color-reproducibility, a toner amount on an electrostatic latent image bearer needs to be faithfully maintained according to an electrostatic latent image. When the toner amount on the electrostatic latent image bearer varies, the resultant image varies in image density and color tone on a recording medium.

The toner amount on the electrostatic latent image bearer varies because the toner varies in charge quantity and Japanese Patent No. JP-3356948-B1 (Japanese published unexamined application No. JP-H09-2521237-A) discloses a following image takes over a history of the last image (ghost phenomenon) in the hybrid developing methods.

The ghost phenomenon disclosed in Japanese Patent No. JP-3356948-B1 (Japanese published unexamined application No. JP-H09-2521237-A) is a specific problem of the hybrid developing method. The toner amount on a toner bearer varies according to a toner consumption pattern of the last image and the following image varies in image density.

This is because, in the hybrid developing method, a specific amount of a toner is constantly fed to the toner bearer and the amount of a toner thereon varies according to the number of receiving a toner.

Namely, after an image consuming less toner is printed, the toner remaining on the toner bearer increases, and after the toner is fed, the toner amount on the toner bearer further increases, and the resultant image has higher image density. Meanwhile, after an image consuming much toner is printed, the toner remaining on the toner bearer decreases, and after the toner is fed, the toner amount on the toner bearer decreases, and the resultant image has lower image density.

As mentioned above, the ghost phenomenon in the hybrid developing method is caused by the toner amount variation on the toner bearer when a following image is produced according to the history of the last image because it is difficult to uniform the amount of the decreased toner after used for development and the amount of the undeveloped toner remaining on the toner bearer when the toner is transferred onto the toner bearer from a two-component developer.

In order to solve these problems, Japanese Patent No. JP-3356948-B1 (Japanese published unexamined application No. JP-H09-2521237-A) and Japanese published unexamined applications Nos. JP-2005-157002-A and JP-H11-231652-A disclose scraping off the toner remaining on the toner bearer therefrom with a scraper or a toner collection roller after developed and before fed again. Japanese published unexamined application No. JP-H07-72733-A discloses a method of collecting the toner remaining on the toner bearer on a magnetic roller by potential difference between copying or papers to stabilize the toner amount on the toner bearer. Further, in order to solve the problem of history development using the magnetic brush, Japanese published unexamined application No. JP-H07-128983-A discloses widening a half width area of a magnetic flux density of the magnetic roll to collect and feed the toner on the toner bearer.

Japanese published unexamined application No. JP-H07-92813-A discloses a method of using a non-spherical carrier to increase the surface area thereof and increasing a ratio of the carriers contacting each other to charge the carrier even at the end of the magnetic brush, narrowing a substantial gap between the developer bearer and the toner bearer to increase the toner amount fed to the toner bearer at a time, and feeding the toner until the toner bearer is saturated with the toner to maintain a specific amount of the toner on the toner bearer and prevent an influence of the last image history.

As disclosed in Japanese published unexamined application No. JP-H11-65247-A, even the two-component developing method has the ghost phenomenon. Poor separation of the developer is thought to cause the ghost phenomenon.

The two-component developing method has an odd number of magnets in the developer bearer and a pair of magnets having the same polarity below the rotational axis of the developing sleeve to form a separation area where a magnetic force is almost zero. The developer naturally falls there by gravity to separate from the developer bearer.

However, the carrier has a counter charge when the toner is consumed in the last image, and an image force generates between the carrier and the developer bearer and the developer does not separate at the separation area. The toner is consumed and the developer having a lowered toner concentration is fed to the developing area again, resulting in production of images having low image density. Namely, images having normal image density are produced for one cycle of the sleeve, but the image density lowers since the second cycle, resulting in the ghost phenomenon.

In order to solve these problems, Japanese published unexamined application No. JP-H11-65247-A discloses a configuration of locating a scoop roll having a magnet inside at the separation area above the developer bearer to separate the developer after developed by the magnetic force. The separated developer is further scooped up by another scoop roll, and fed to a developer stirring chamber where the toner concentration is adjusted again and the toner is charged.

Because of these reasons, a need exist for a carrier having good durability, consuming a stable amount of a toner for development without influence of the toner consumption history of the last image, producing uniform images having good color reproducibility for long periods.

SUMMARY

Accordingly, one object of the present invention is to provide a carrier having good durability, consuming a stable amount of a toner for development without influence of the toner consumption history of the last image, producing uniform images having good color reproducibility for long periods, and having stable chargeability, good abrasion resistance, less resistivity variation and no adherence to cause inner contamination and production of abnormal images for long periods.

Another object of the present invention is to provide a two-component developer using the carrier.

A further object of the present invention is to provide a process cartridge using the developer.

Another object of the present invention is to provide an image forming apparatus using the developer.

A further object of the present invention is to provide an image forming method using the developer.

Another object of the present invention is to provide a developer for supply using the carrier and a toner.

These objects and other objects of the present invention, either individually or collectively, have been satisfied by the discovery of a carrier for developing electrostatic latent images, comprising:

a core material; and a covering layer formed of a resin comprising an electroconductive particulate material, overlying the core material, wherein the covering layer comprises the electroconductive particulate material in an amount of from 58 to 73% by weight and has a resistivity of from 6.6 to 8.6 Ωcm, and wherein the carrier has a high-brightness contrast part at an areal ratio less than 1% and 40 to 90% based on total area thereof at an acceleration voltage of 0.8 KV and 2.0 KV, respectively in an FE-SEM reflection electron image of the surface thereof.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein:

Each of FIGS. 1A, 1B and 1C is a schematic view illustrating a cross-section of a carrier having a covering resin layer;

Figure 2A:
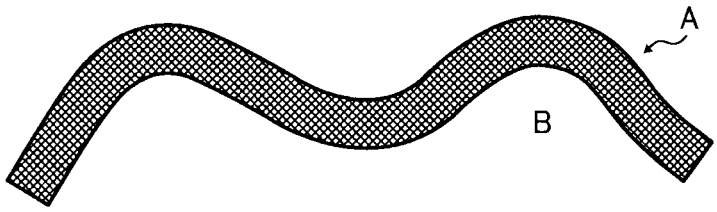
Figure 2B:
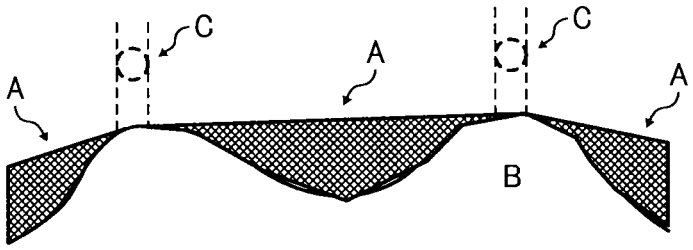
Figure 2C:
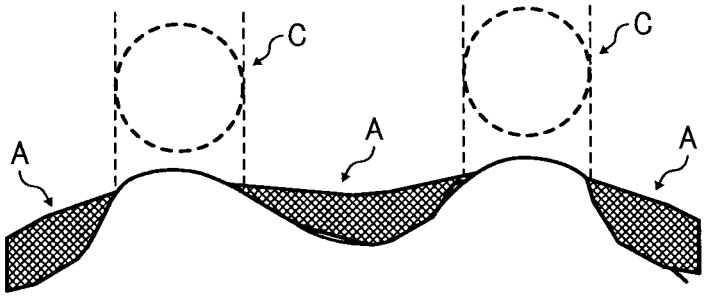
Figure 3:
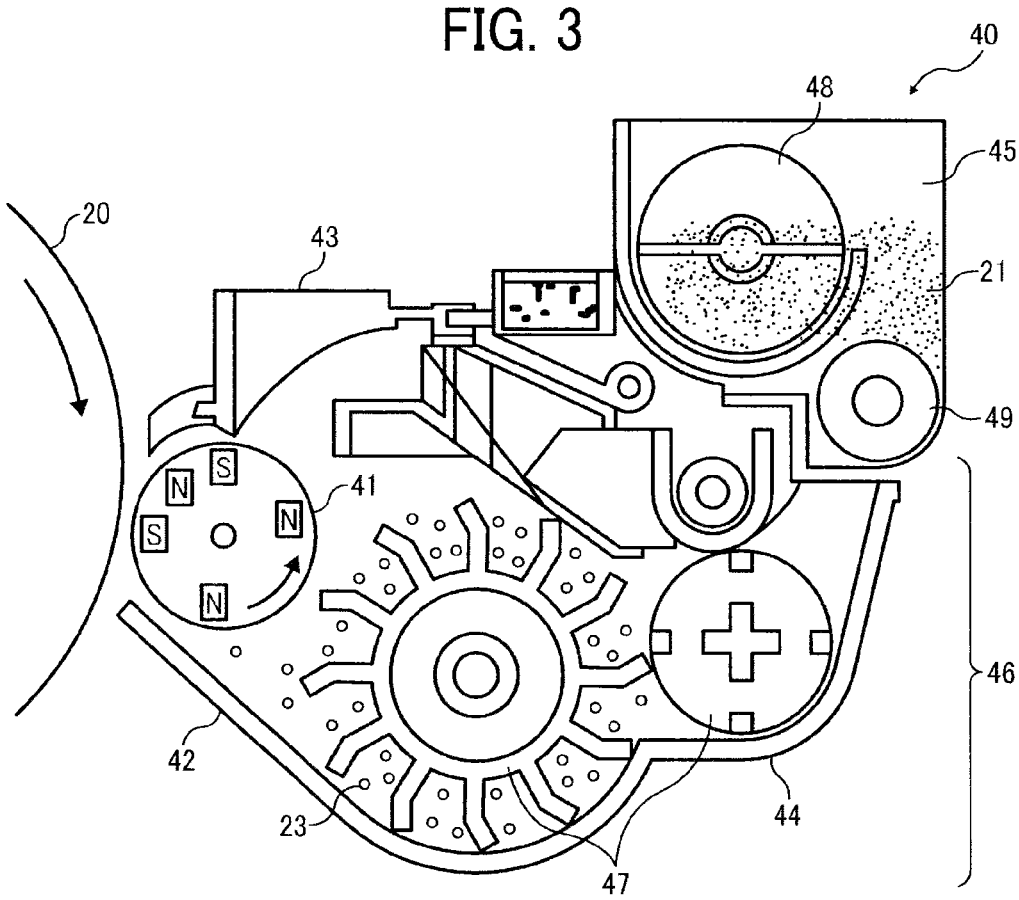
Figure 4:
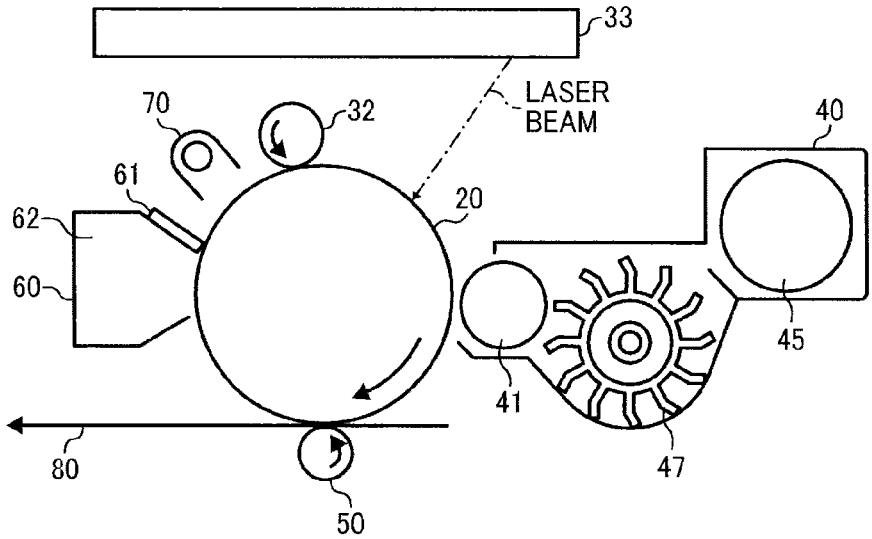
Figure 5:
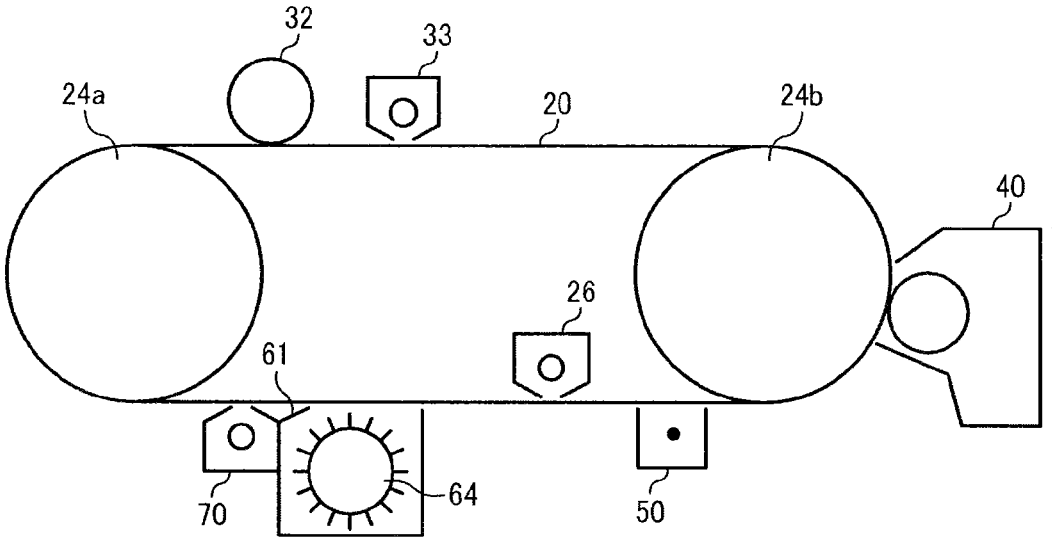
Figure 6:
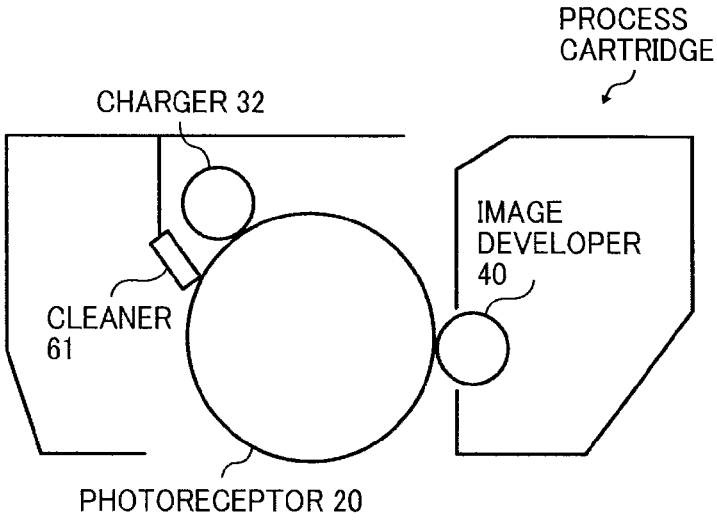
Figure 7:
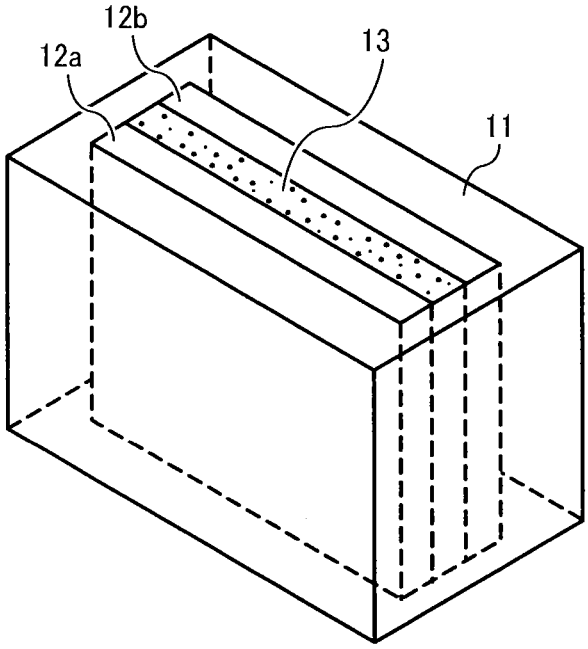
Figure 8:
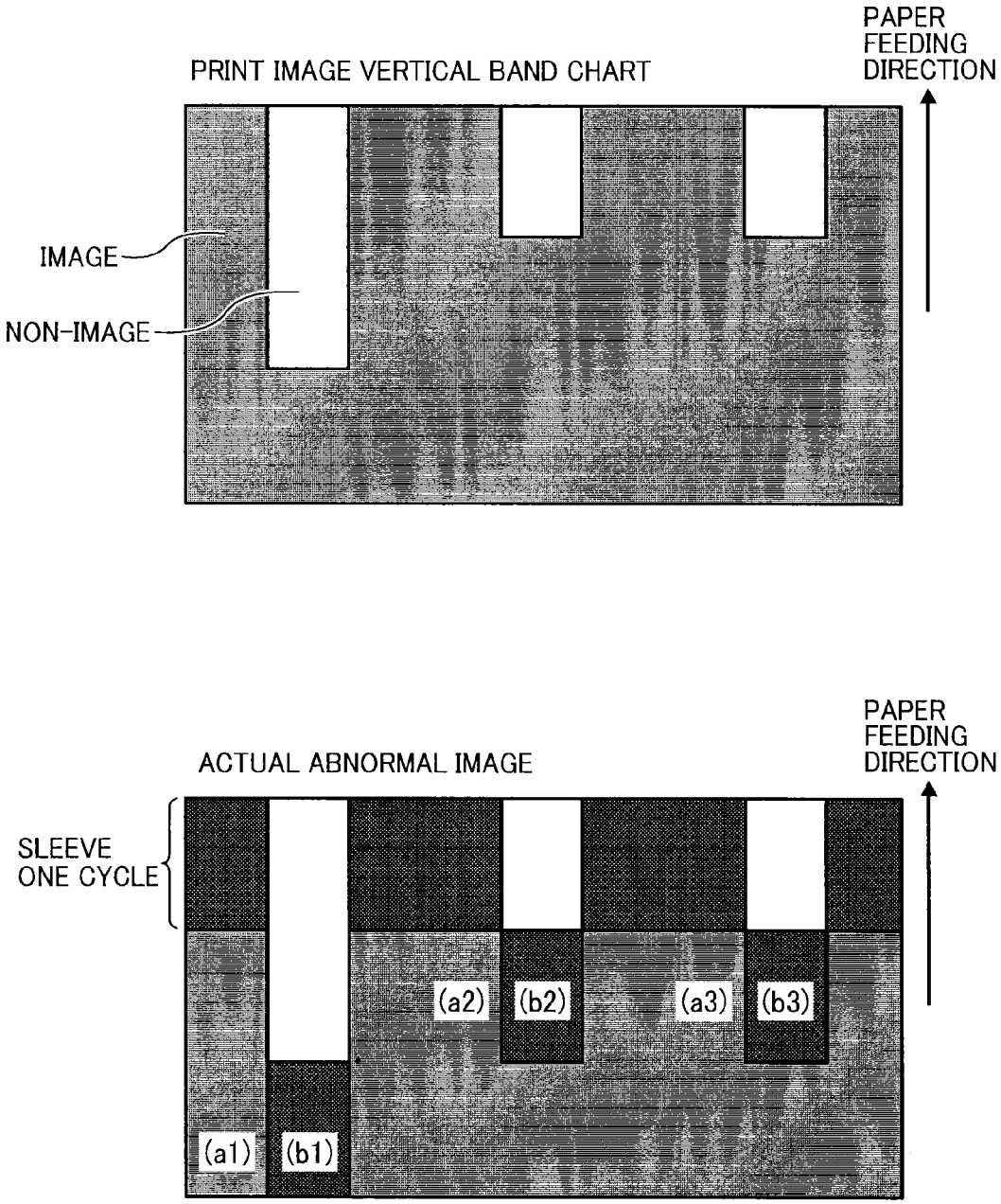

Each of FIGS. 2A, 2B and 2C is a schematic view illustrating abrasion and peeling of the covering resin layer;

FIG. 3 is a schematic view illustrating an embodiment of image developer of the image forming apparatus and image forming method of the present invention;

FIG. 4 is a schematic view illustrating an embodiment of image forming apparatus of the present invention;

FIG. 5 is a schematic view illustrating another embodiment of image forming apparatus of the present invention;

FIG. 6 is a schematic view illustrating an embodiment of process cartridge of the present invention;

FIG. 7 is a perspective view illustrating a resistivity measuring cell used for measuring electric resistivity of a carrier; and FIG. 8 is a vertical band chart for evaluating ghost images.

DETAILED DESCRIPTION

The present invention provides a carrier having good durability, consuming a stable amount of a toner for development without influence of the toner consumption history of the last image, producing uniform images having good color reproducibility for long periods, and having stable chargeability, good abrasion resistance, less resistivity variation and no adherence to cause inner contamination and production of abnormal images for long periods.

More particularly, the present invention relates to a carrier for developing electrostatic latent images, comprising:

a core material; and a covering layer formed of a resin comprising an electroconductive particulate material, overlying the core material, wherein the covering layer comprises the electroconductive particulate material in an amount of from 58 to 73% by weight and has a resistivity of from 6.6 to 8.6 Ωcm, and wherein the carrier has a high-brightness contrast part at an areal ratio less than 1% and 40 to 90% based on total area thereof at an acceleration voltage of 0.8 KV and 2.0 KV, respectively in an FE-SEM reflection electron image of the surface thereof.

The high-brightness contrast part is mainly formed of a metallic component or a metallic part covered with a very thin resin. It is preferable that the covering resin layer is mainly formed of a resin component at the surface and a metallic component such as an electroconductive particulate material and a core material inside.

Figure 1A:
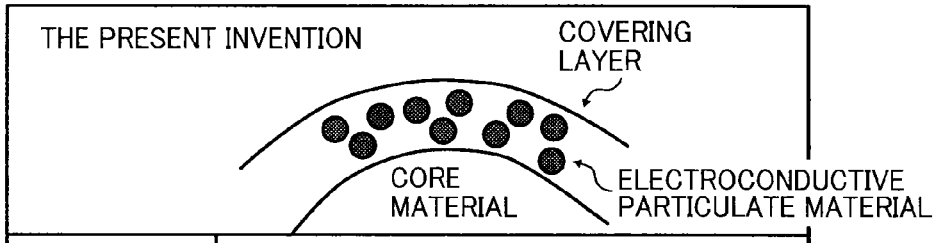
Figure 1B:
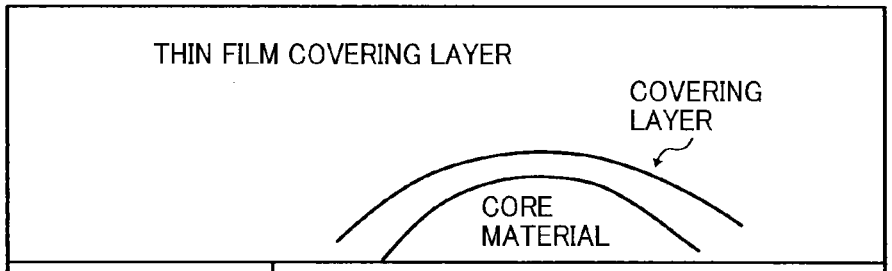
Figure 1C:
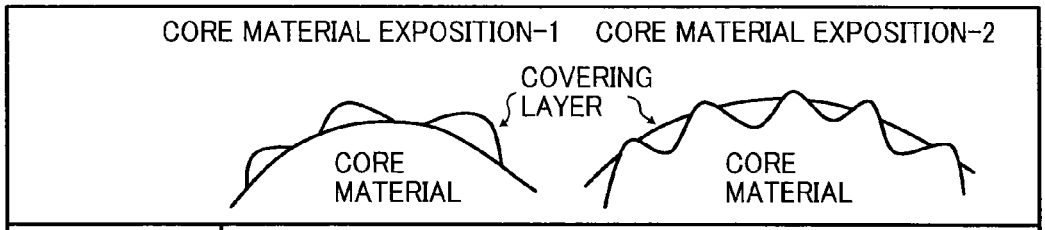

Covering resin layers in FIGS. 1A, 1B and 1C are thought as low resistivity covering resin layers.

The higher the acceleration voltage, the deeper electron penetrates to obtain inner information of the covering resin layer and specify a distribution of a low resistivity component such as an electroconductive particulate material and a core material in the covering resin layer and the inside of the carrier. This can assume the carrier when production of images starts and after the covering resin layer thereof is abraded. The carrier of the present invention does not cause problems such as adherence thereof and deterioration of developability due to resistivity variation so much, because the resistivity does not vary after the covering resin layer wears at the very beginning of producing images and an electroconductive particulate material is locally exposed.

The areal ratio of the high-brightness contrast part on the surface is determined from a reflection electron image taken by Carl Zeiss Schottky Fe-SEM ULTRA55 from Carl Zeiss, which is subjected to an image process with an image process software Image Pro Plus Ver5.0.1 from Media Cybernetics, Inc.

(1) Reflection Electron Image

Carriers are fixed on a carbon tape, and reflection electron images thereof are taken without being evaporated on the surface of the carbon tape. Basically, the images are taken at 8 bit (256 tones).

Imaging conditions and image processing conditions are shown in Tables 1 and 2.

TABLE 1

| | | |
|---|---|---|
| Acceleration voltage EHT | 0.8 kV | 2.0 kV |
| Magnification | x800 | x800 |
| Detector Signal A | ESB | ESB |
| Working Distance | 4 mm | 4 mm |
| Aperture Size | 30 μm | 30 μm |
| ESB Grid | 900 V | 1500 V |
| Contrast | 95% | 95% |
| Brightness | 10% | 10% |

TABLE 2

| | |
|---|---|
| Store resolution | 1024 × 768 |
| Scan speed | 6 (cycle = 23.4 sec) |
| Noise reduction | Line Avg. (N = 9) |

(2) Image Process

Ten (10) carrier images are extracted from the image obtained in (1) under the flowing conditions, and a total area A of each the carriers is measured.

Brightness range: 120 to 251

Size: 1,000 to $1\times10^9$

Extract option in software: "4 links", "smoothness 5" and "hole filling" are selected in software menu.

Next, a high-brightness contrast part area B of each of the carriers is measured under the flowing conditions.

Brightness range: 140 to 253

Size: 1 to $1\times10^9$

Extract option in software: "4 links", "smoothness 5" and "hole filling" are selected in software menu.

An average of B/A×100 of each of the 10 carriers is determined as then areal ratio (%) of the high-brightness contrast part.

(Ghost)

The ghost phenomenon in the present invention is different from those of any of the above-mentioned ghost phenomena. Although not clarified, the occurrence mechanism of the ghost phenomenon in the present invention is thought as follows. When a charged toner is attached to an electrostatic latent image on a photoreceptor (an electrostatic latent image bearer) to form a visual (toner) image in electrophotographic image formation, the toner adheres onto a developer bearer according to the last image history, and a toner development amount of the following image varies according to a potential of the toner having adhered onto the developer bearer. Namely, the ghost phenomenon is caused by variation of the toner development amount of the following image due to the last image history.

In detail, the toner adherence to the developer bearer occurs because the toner is developed onto the developer bearer when a bias is applied in a developing sleeve direction in forming non-image part. The toner developed onto the developer bearer has a potential and the toner development amount increases by the potential thereof in printing. The toner developed onto the developer bearer is consumed in development and the toner amount on the developer bearer is not constant and varies according to the history of the last image. Namely, when the last image has no image or between papers, a toner is developed on the developer bearer and adheres thereon, resulting in higher image density. When the last image has a large image area, a toner on the developer bearer decreases, resulting in lower image density.

The object of the present invention is a phenomenon in which a toner development amount on a developer bearer varies according to the last image, resulting in variation of image density of the following image.

The present invention improves the phenomenon.

It is not clarified, but a local low resistivity part in the covering resin layer is thought to make a toner on a developer bearer consumed less in printing, which is maintained even after the covering resin layer is abraded due to long terms use, and an amount of the toner on the developer bearer is stable initially and after used for long periods regardless of the last image, leading image uniformity.

(Prevention of Covering Resin Layer Abrasion at Convex Part)

A large electroconductive particulate material having an average primary particle diameter of from 0.15 to 0.5 μm dispersed in the resin of the covering resin layer has a spacer effect at a convex part to prevent abrasion thereof.

In the present invention, a spacer effect of a large filler, abrasion resistance of the filler effect and peeling prevention of improved adherence of a core materials and a resin do not expand an exposed area of the core material at a convex part and prevent specific problems of a concave and convex core material (prevention of local abrasion/damage of a convex part abrasion stress concentrates on→rapid lowering of resistivity and carrier adherence).

Each of FIGS. 2A, 2B and 2C is a schematic view illustrating abrasion and peeling of the covering resin layer. FIG. 2A is a cross-sectional view of a carrier before deteriorated, FIG. 2B is a cross-sectional view of a carrier 1 after deteriorated, and FIG. 2C is a cross-sectional view of a carrier 2 after further deteriorated. A, B and C represent a cross-sectional view of a covering resin layer, a cross-sectional view of a core material and a top view of an exposed part of the core material, respectively.

A conventional carrier locally expands an exposed part of its core material from carrier 1 to carrier 2, but the carrier of the present invention stops peeling and abrasion of its covering resin layer at carrier 1, minimizes an exposed area of its core material, and does not expand the exposed area much as time passes.

(Electroconductive Particulate Material)

The covering resin layer includes an electroconductive particulate material to be strengthened and control resistivity of the carrier. The present inventors found that en electroconductive particulate material having an electroconductive covering resin layer on an alumina substrate has high controllability of a specific volume resistivity of the carrier and an after-mentioned affinity with a tough copolymer having a small surface energy not to vary the carrier resistivity and a amount of a developer drawn, prevent variation of image density and produce high-quality images for long periods when used in a carrier covered by a resin obtained by heating a silicone resin having a silanol group and/or a hydrolyzable functional group.

A carrier frictionally charged with a toner is thought to preferably have a substrate having electronegativity away from that of the toner in terms of chargeability. A carrier preferably has a substrate having low electronegativity to have higher chargeability when a negatively-charged toner including silica or titanium oxide having higher electronegativity as an additive. When alumina having low electronegativity is used as a substrate, the chargeability can be maintained and high-quality images can be produced for long periods. However, when a substrate having high electronegativity such as titanium oxide besides alumina, even though the chargeability is initially controllable, the chargeability cannot be maintained and image quality deteriorates after used for long periods.

α-alumina, β-alumina and γ-alumina can be used, and preferably have an average particle diameter of from 0.1 to 0.5 μm, and more preferably from 0.15 to 0.3 μm, and a specific surface area of from 5 to 30 $m^2/g$.

The electroconductive particulate material preferably has an electroconductive covering resin layer including tin dioxide or a combination of tin dioxide and indium oxide. The electroconductive covering resin layer including tin dioxide or a combination of tin dioxide and indium oxide can uniformly cover the surface of a substrate and has good electroconductivity without influence of the substrate. Particularly, the electroconductive covering resin layer including tin dioxide is preferably used because of having enough resistivity controllability and being inexpensive.

When the electroconductive covering resin layer includes tin dioxide, the electroconductive particulate material preferably includes tin dioxide in an amount of from 4 to 80% by weight, and more preferably from 30 to 50% by weight. When less than 4% by weight, the electroconductive particulate material has high specific volume resistivity and is added to the carrier so much that it is likely to release therefrom. When greater than 80% by weight, the electroconductive particulate material does not have specific volume resistivity low enough and is inefficiently and unevenly added to the carrier.

When the electroconductive covering resin layer includes a combination of tin dioxide and indium oxide, the electroconductive particulate material preferably includes tin dioxide and indium oxide in an amount of from 2 to 7% by weight and 15 to 40% by weight, respectively.

The average primary particle diameter of the electroconductive particulate material is measured by observing a cross-section of the carrier with a transmission electron microscope (TEM) and determining an average of the diameters of the electroconductive particulate materials in the covering resin layer covering the surface of the carrier. Specifically, shorter diameters of 10 electroconductive particulate materials in the cross-section of the carrier are measured and an average thereof is the average primary particle diameter. As for an average primary particle diameter of an alumina substrate, a catalog value of the manufacturer is used.

The carrier preferably includes the electroconductive particulate material in an amount of from 3 to 8% by weight per 100% by weight of a core material. When less than 3% by weight, the specific volume resistivity of the carrier is insufficiently controlled in some cases. When greater than 8% by weight, the electroconductive particulate material is difficult to hold and the surface of the carrier is easy to break.

(Covering Resin Layer Resistivity)

The covering resin layer of the carrier of the present invention has a resistivity of from 6.6 to 8.6 Ωcm. The resistivity of the carrier covering resin layer is controlled to produce high-definition images without ghost phenomenon and color contamination, having less edge effect and good thin line reproducibility such as letters. When less than 6.6 Ωcm, the carrier occasionally adheres to non-image areas. When greater than 8.6 Ωcm, ghost phenomenon occasionally deteriorates too much to accept. The covering resin layer resistivity can be controlled by controlling resistivity of a covering resin layer on the particulate core material (such as an amount of the electroconductive particulate material) and the thickness of the covering resin layer.

The present inventors found that both of the carrier resistivity (including the core material and the covering resin layer) and the covering resin layer resistivity are preferably low particularly against host phenomenon, and that the covering resin layer resistivity contributes more than the carrier resistivity.

The covering resin layer resistivity is measured by the following method.

A solution including toluene in which components forming the covering resin layer such as a resin, an electroconductive particulate material and a catalyst are dissolved is coated by a wire bar on an aluminum substrate having a thickness of 0.2 mm to form a coated film having a thickness of form 2 to 4 μm thereon. The coated film is dried and fired at the same temperature and time when preparing the carrier to form a covering resin layer on the aluminum substrate. The thickness of the covering resin layer after fired is measured by a surface roughness and shape measurer (Surfcom 1400G-LCD from TOKYO SEIMITSU CO., LTD.). Next, the surface of the covering resin layer is evaporated with gold and an electroconductive metallic tape is placed thereon to form an electrode. A current is measured at an application voltage of 5 V, and the covering resin layer resistivity is determined from the thickness thereof, the current and the application voltage.

(Filler Amount)

The covering resin layer includes the electroconductive particulate material in an amount of from 58 to 73% by weight, by which the covering resin layer resistivity is controllable and strength of the covering resin layer is preferably maintained through filler effect. When less than 58% by weight, the covering resin layer is not fully strengthened and the carrier resistivity is not sufficiently controlled in some cases. When greater than 73% by weight, the electroconductive particulate material (filler) is likely to release and the specific volume resistivity of the carrier is likely to vary.

(Covering Resin Layer Strength and Thickness)

In the present invention, after the covering resin layer composition is coated on the core material, a crosslinking reaction of the covering resin layer composition by condensation is accelerated when heated at less than the Curie point, preferably from 100 to 350° C., and more preferably from 150 to 250° C.

When lower than 100° C., the crosslinking reaction by condensation is not accelerated, and the covering resin layer does not have enough strength.

When higher than 350° C., the copolymer is carbonated and the covering resin layer is likely to wear.

In the present invention, the covering resin layer of the carrier preferably has an average thickness of from 0.3 to 0.5 μm in terms of controllability of the resistivity of the layer and strength maintenance thereof due to filler effect. When less than 0.3 μm, the covering resin layer is likely to peel off. When greater than 0.5 μm, the carrier resistivity is insufficiently adjusted is some cases.

The average thickness of the covering resin layer is measured by observing a cross-section of the carrier with a transmission electron microscope (TEM) and determining an average thickness thereof.

The average thickness of the covering resin layer is a thickness of the resin, excluding the electroconductive particulate material.

(Particulate Core Material)

The particulate core material of the carrier is a magnetic material. Specific examples of the magnetic material include, but are not limited to, ferromagnetic materials such as iron and cobalt), iron oxides such as magnetite, hematite and ferrite, alloys, and resin particles in which magnetic materials are dispersed. Among these materials, Mn ferrite, Mn—Mg ferrite, and Mn—Mg—Sr ferrite are preferably used in consideration of the environment.

The particulate core material preferably has a weight-average particle diameter (Dw) of from 20 to 65 μm, and more preferably from 20 to 45 μm. When too large, the carrier is difficult to adhere, but a latent image is not faithfully developed with a toner and a dot diameter largely varies, resulting in deterioration of granularity. When a toner has high concentration, background fouling is likely to occur.

The carrier adherence means that the carrier adheres to electrostatic latent images or background. The stronger the electric field, the more the carrier adheres. The carrier adheres to images less than to background because a toner is developed to form the images and an electric field thereon decreases.

In the present invention, the weight-average particle diameter (Dw) of a carrier and a toner is calculated based on a particle diameter distribution (i.e., a relation between number frequency and particle diameter) of particles as follows:

$$Dw=\{1/\Sigma(nD^3)\}\times\{\Sigma(nD^4)\}$$

wherein D represents a representative particle diameter (μm) of particles present in each channel and n represents the number of the particles present in each channel.

The channel represents a unit length that divides the measuring range of particle diameter into a measuring unit width. In this specification, the channel has a length of 2 μm.

The minimum particle diameter present in each channel is employed as the representative particle diameter.

The core material preferably has a bulk density of from 1.8 to 2.3 g/cm$^3$. The bulk density is measured according to a metallic powder apparent density test method (JIS-Z-2504) in which a carrier is naturally flown out of an orifice having a diameter of 3.0 mm, the carrier is flown in a 25 cm$^3$ stainless cylindrical container located just below the orifice until flown out, and the upper surface of the container is once scraped horizontally with a non-magnetic paddle along the upper end of the container. The weight of the carrier flown in the container is divided the capacity 25 cm$^3$ of the container to determine a weight of the carrier per 1 cm$^3$.

(Surface Roughness Ra of Core Material)

The core material preferably has a surface roughness Ra (arithmetic average roughness) of from 0.3 to 0.4 μm, i.e., a small difference between concavities and convexities.

The core material preferably has a smooth surface because (1) the covering resin layer is uniformly be coated and the electroconductive particulate material is uniformly distributed, and (2) frictional forces and impacts concentrate only on convexities when rough, and which is abraded to expose the core material. When the core material is exposed more, an electroconductive route is formed and the carrier resistivity quickly lowers, possibly resulting in problems such as carrier adherence when images are formed. When Ra is less than 0.3, the concavities and convexities do not scrape a toner, resulting in adhesivenss to a toner. When not less than 0.4, (1) is difficult and (2) is likely to occur.

The surface roughness Ra (arithmetic average roughness) is specifically measured by measuring a range of 12×12 μm the surface of each 50 carriers with an ultradeep color 3D shape measuring microscope (VK-9500 from Keyence Corp.) at 3.000-fold magnification.

A roughness curve is determined from the 3D shape of the core surface, and total absolute values of deviations from the roughness curve to an average line are averaged. The standard length is 10 μm, the cutoff value is 0.08 mm. Ra (arithmetic average roughness) and an average distance between concavities and convexities (Sm) are measured according to JIS B 0601 (published in 1994).

(Carrier Shape and Magnetization)

The shape of the carrier is basically controlled by the shape of the core material. Therefore, the carrier has Ra in a range of 0.9 to 1.0 times of Ra of the core material. Particularly when a filler is included much, the carrier occasionally has smaller Ra. The carrier preferably has a magnetization of from 40 to 90 Am$^2$/kg in a magnetic field of 1 kOe ($10^6/4\pi$ [A/m]). When less than 40 Am$^2$/kg, the carrier occasionally adheres to images. When greater than 90 Am$^2$/kg, a magnetic ear is hardened, resulting in occasional blurred images.

The covering resin layer preferably includes a silicone resin having a silanol group and/or a functional group capable of producing a silanol group by hydrolysis.

The silicone resin having a silanol group and/or a functional group capable of producing a silanol group by hydrolysis (e.g., alkoxy groups and anionic groups such as halogeno groups bonded with Si atom) can condensation polymerize directly with a crosslinked component B of a copolymer mentioned later or with a crosslinked component B which is changed to a silanol group. The copolymer including the silicone resin further improves adhesiveness to a toner.

The silicone resin having a silanol group and/or a functional group capable of producing a silanol group by hydrolysis preferably includes at least one of repeat units having the following formulae (III):

(III)

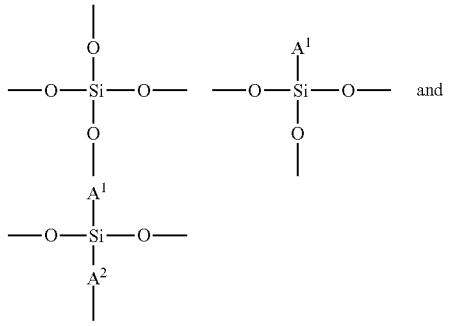

wherein $A^1$ represents a hydrogen atom, a hydroxy group, a methoxy group, a lower alkyl group having 1 to 4 carbon atoms or an aryl group such as a phenyl group and a tolyl group; $A^2$ represents an alkylene group having 1 to 4 carbon atoms or an arylene groups such as a phenylene group.

The aryl group in the formulae (III) preferably has 6 to 20, and more preferably 6 to 14 carbon atoms. The aryl group includes aryl groups from condensed polycyclic aromatic hydrocarbons such as naphthalene, phenanthrene and anthracene; aryl groups from chained polycyclic aromatic hydrocarbons such as biphenyl and terphenyl; besides aryl (phenyl) groups from benzene. Various substituents may be bonded with the aryl group.

Specific examples of the commercially available silicone resins include, but are not limited to, KR251, KR271, KR272, KR282, KR252, KR255, KR152, KR155, KR211, KR216, and KR213 (from Shin-Etsu Chemical Co., Ltd.); and AY42-170, SR2510, SR2400, SR2406, SR2410, SR2405, and SR2411 (from Dow Corning Toray Co., Ltd.).

Among various silicone resins, methyl silicone resins are preferable because they are less adhesive to toner and their charge is less susceptible to environmental fluctuation.

The silicone resin preferably has a weight average molecular weight of 1,000 to 100,000, more preferably 1,000 to 30,000. When the weight average molecular weight is too large, the resulting covering resin layer may be not uniform because the coating liquid has too large a viscosity. Moreover, the hardened covering resin layer may have a low density. When the weight average molecular weight is too small, the hardened covering resin layer may be too brittle.

The covering resin layer preferably includes the silicone resin in an amount of from 5 to 80% by weight, and more preferably from 10 to 60% by weight, based on total weight of the resins included therein. When the content of the silicone resin is too small, the resulting covering resin layer may be adhesive to toner. When the content of the silicone resin is too large, the resulting covering resin layer may have poor toughness and may be easily abraded.

Specific examples of resins besides the silicone resin having a silanol group and/or a hydrolyzable functional group include, but are not limited to, acrylic resins, amino resins, polyvinyl resins, polystyrene resins, halogenated olefin resins, polyester resins, polycarbonate resins, polyethylene resins, polyvinyl fluoride resins, polyvinylidene fluoride resins, poly(trifluoroethylene) resins, poly(hexafluoropropylene) resins, copolymer of vinylidene fluoride and vinyl fluoride, fluoroterpolymer (e.g., terpolymer of tetrafluoroethylene, vinylidene fluoride, and a non-fluoride monomer), and silicone resins having no silanol group and/or no hydrolyzable group. Two or more of these resins can be used in combination. Among these resins, the acrylic resins are preferably used because of having high adhesiveness to the particulate core material and the electroconductive particulate material and low fragility.

As a covering resin layer composition, a resin component therein preferably has a crosslinked structure obtained by condensing a silanol group produced by hydrolyzing a copolymer having the following formula (IV) obtained by radically polymerizing an A component having the following formula (I) and a B component having the following formula (II).

(I)

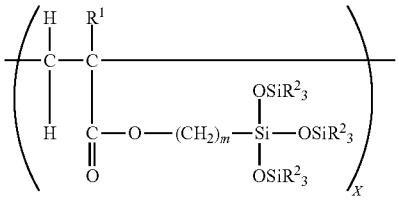

(II)

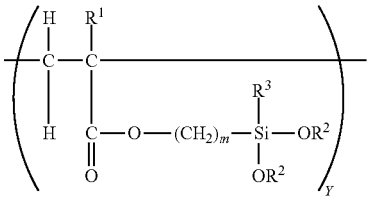

(IV)

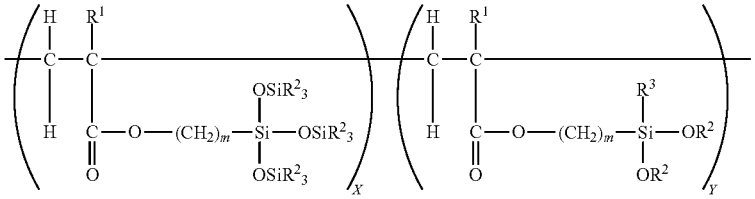

wherein $R^1$ represents a hydrogen atom or a methyl group; m represents an integer of from 1 to 8; $R^2$ represents an aliphatic hydrocarbon group such as methyl groups, ethyl groups propyl groups and butyl groups having 1 to 4 carbon atoms; $R^3$ represents alkyl groups such as methyl groups, ethyl groups, propyl groups and butyl groups having 1 to 8 carbon atoms or alkoxy groups such as methoxy groups, ethoxy groups, propoxy groups and butoxy groups having 1 to 4 carbon atoms; and X and Y follows.

X in the component A is preferably 10 to 90% by mol, and more preferably from 30 to 70% by mol. The A component has an atomic group tris(trimethylsiloxy)silane having a side chain in which many methyl groups are present. When a ratio of the A component is high relative to the total resin, the toner has small surface energy and resin components and waxes adhere less. When less than 10% by mol, the toner components increases. When greater than 90% by mol, the component B decreases and the covering resin layer is not well crosslinked, resulting in insufficient toughness, adhesiveness between the core material and the covering resin layer and durability thereof.

$R^2$ represents an alkyl group having 1 to 4 carbon atoms in the formula (I). Such monomer components include tris(trialkylsiloxy) silane compounds having the following formulae:

$CH_2{=}CMe\text{-}COO{-}C_3H_6{-}Si(OSiMe_3)_3$ $CH_2{=}CH{-}COO{-}C_3H_6{-}Si(OSiMe_3)_3$ $CH_2{=}CMe\text{-}COO{-}C_4H_8{-}Si(OSiMe_3)_3$ $CH_2{=}CMe\text{-}COO{-}C_3H_6{-}Si(OSiEt_3)_3$ $CH_2{=}CH{-}COO{-}C_3H_6{-}Si(OSiEt_3)_3$ $CH_2{=}CMe\text{-}COO{-}C_4H_8{-}Si(OSiEt_3)_3$ $CH_2{=}CMe\text{-}COO{-}C_3H_6{-}Si(OSiPr_3)_3$ $CH_2{=}CH{-}COO{-}C_3H_6{-}Si(OSiPr_3)_3$ $CH_2{=}CMe\text{-}COO{-}C_4{-}H_8{-}Si(OSiPr_3)_3$ wherein Me represents a methyl group; Et represents an ethyl group and Pr represents a propyl group.

(A Component)

Methods of preparing the A component are not particularly limited, and a method of reacting tris(trialkylsiloxy) silane with allyl acrylate or allyl methacrylate under the presence of a platinum catalyst, a method of reacting methacryloxy alkyl trialkoxy silane with hexaalkyldisiloxane under the presence of a carboxylic acid and an acid catalyst, disclosed in Japanese published unexamined application No. JP-H11-217389-A, etc. can be used.

(B Component: Crosslinking Component)

The B component is a radically polymerizable di- or trifunctional silane compound, and Y is 10 to 90% by mol, and preferably from 30 to 70% by mol. When less than 10% by mol, the coated layer has a few crosslinked points and does not have enough toughness. When greater than 90% by mol, the coated layer is hard and fragile, and easy to abrade. Further, hydrolyzed crosslinking components remaining in a large amount as a silanol group are thought to deteriorate moisture resistance of the coated layer.

Specific examples of the B component include 3-methacryloxypropyltrimethoxysilane, 3-acryloxypropyltrimethoxysilane, 3-methacryloxypropyltriethoxysilane, 3-acryloxypropyltriethoxysilane, 3-methacryloxypropylmethyldimethoxysilane, 3-methacryloxypropylmethyldiethoxysilane, 3-methacryloxypropyltri(isopropoxy)silane and 3-acryloxypropyltri(isopropoxy)silane.

In the present invention, an acrylic compounds (monomer) may be added to the A and B components as a C component kike a copolymer having the following formula (V).

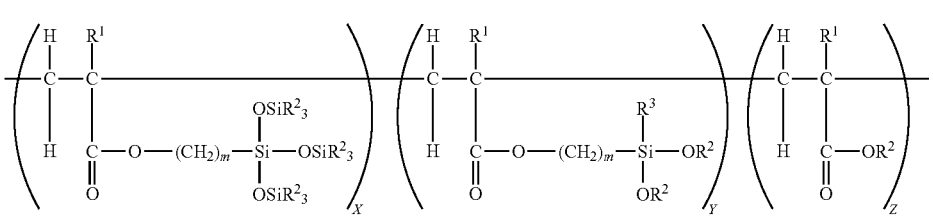

(V)

A component:

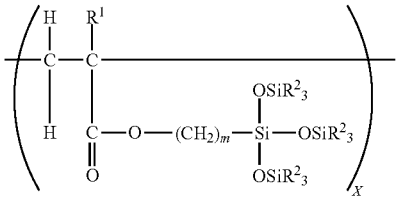

(I)

B component:

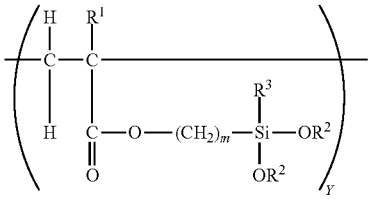

(II)

C component:

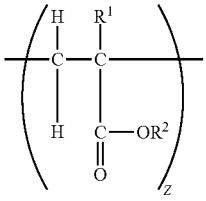

(VI)

wherein $R^1$ represents a hydrogen atom or a methyl group; m represents an integer of from 1 to 8; $R^2$ represents an aliphatic hydrocarbon group such as methyl groups, ethyl groups propyl groups and butyl groups having 1 to 4 carbon atoms; $R^3$ represents alkyl groups such as methyl groups, ethyl groups, propyl groups and butyl groups having 1 to 8 carbon atoms or alkoxy groups such as methoxy groups, ethoxy groups, propoxy groups and butoxy groups having 1 to 4 carbon atoms; X=10 to 40% by mol; Y=10 to 40% by mol; Z=30 to 80% by mol; and 60% by mol <Y+Z<90% by mol.

When the C component is greater than 80% by mol, Y or Y is less than 10, the coated layer is difficult to have repellency, hardness and flexibility. When less than 30% by mol, the coated layer does not occasionally have sufficient adhesiveness.

As the C component, acrylate and methacrylate are preferably used, specifically including methyl methacrylate, methyl acrylate, ethyl methacrylate, ethyl acrylate, butyl methacrylate, butyl acrylate, 2-(dimethylamino)ethyl methacrylate, 2-(dimethylamino)ethyl acrylate, 3-(dimethylamino)propyl methacrylate, 3-(dimethylamino)propyl acrylate, 2-(diethylamino)ethyl methacrylate and 2-(diethylamino)ethyl acrylate. Among these, alkyl methacrylate is preferably used, and methyl methacrylate is more preferably used. These compounds may be used alone or in combination.

As a technique enhancing durability by crosslink of coating, there is one described in Japanese Patent No. JP-3691115-B1. Namely, in regard to the one described in Japanese Patent No. JP-3691115-B1 specification, it is a carrier for an electrostatic image development characterized by coating the surface of magnetic particle with a thermosetting resin that a copolymer of an organopolysiloxane having at least a vinyl group at the end and a radical copolymerizable monomer having at least one functional group selected from the group consisting of hydroxyl group, amino group, amide group and imide group is cross-linked by an isocyanate compound, but the actual situation is that no sufficient durability on peeling and scraping of coating is obtained.

Although the reason has been not cleared sufficiently, in the case of thermosetting resin that the foregoing copolymer is cross-linked by an isocyanate compound, as is known from the structural formula, functional groups (active hydrogen-containing groups) per unit weight reacting (cross-linking) an isocyanate compound in a copolymer resin are too few to form a two-dimensionally or three-dimensionally dense crosslink structure at a crosslink point. Therefore, it is inferred that in a prolonged use, peeling and scraping of coating occur easily (abrasion resistance of coating is poor), so a sufficient durability is not obtained.

When peeling and scraping of coating occur, change of image quality due to the lowering of carrier resistance and carrier adhesion take place. Peeling and scraping of coating deteriorates flow properties of developer, leading to the lowering of amount scooped, and causing the lowering of image concentration, background fouling due to TC up, and scattering of toner.

In the present invention, it uses a copolymer resin having a lot of functional groups (points) capable of cross-linking being difunctional or trifunctional per resin unit weight (per unit weight, as many as 2 to 3 times), and this is further cross-linked by condensation polymerization, hence it is thought that coating is very tough and hardly scraped, leading to high durability.

Compared with crosslink by an isocyanate compound, crosslink by siloxane bond in the present invention is larger in bond energy and more stable to heat stress, hence it is inferred that stability of coating with time is maintained.

(Acrylic Resin)

The acrylic resin preferably has a glass transition temperature of from 20 to 100° C., and more preferably from 25 to 80° C. Such an acrylic resin has suitable elasticity and absorbs an impact due to friction between a toner and a carrier or carriers to the covering resin layer when a developer is frictionally charged to prevent deterioration of the covering resin layer and the electroconductive particulate material.

It is preferable that the covering resin layer components further include a crosslinked material of an acrylic resin and an amino resin, which prevents the covering resin layers from thermally adhering to each other. Specific example of the amino resin include, but are not limited to, melamine resins and benzoguanamine resins capable of improving chargeability of the carrier. When chargeability of the carrier needs controlling, other amino resins may be used with the melamine resin and/or the benzoguanamine resins.

The acrylic resin capable of crosslinking with the amino resin preferably has a hydroxyl group and/or a carboxyl group, and more preferably has a hydroxyl group. This further improves adhesivenss between the particulate core material and the electroconductive particulate material, and dispersion stability of the electroconductive particulate material. The acrylic resin preferably has a hydroxyl value not less than 10 mg KOH/g, and more preferably not less than 20 mg KOH/g.

In order to accelerate condensation reaction of crosslinking components in the covering resin layer such as a silicone resin having a silanol group and/or a hydrolyzable functional group, a titanium catalyst, a tin catalyst, a zirconium catalyst and an aluminum catalyst can be used. Among the titanium catalysts having good effects in these catalysts, titanium alkoxide and titanium chelate are preferably used in particular.

It is thought this is because these effectively accelerate condensation reaction of a silanol group from the crosslinking component B and the catalyst is not easily deactivated. Specific examples of the titanium alkoxide include titanium diisopropoxybis(ethylacetoacetate) having the following formula (5), and specific examples of the titanium chelate include titanium diisopropoxybis(triethanolaminato) having the following formula (6).

$$Ti(O\text{-}i\text{-}C_3H_7)_2(C_6H_9O_3)_2 \quad (5)$$

$$Ti(O\text{-}i\text{-}C_3H_7)_2(C_6H_{14}O_3)_2 \quad (6)$$

The covering resin layer is formed with a silicone resin having a silanol group and/or a hydrolyzable functional group and a titanium diisopropoxybis(ethylacetoacetate) catalyst, or a solvent including the resin and the catalyst when necessary.

Specifically, the silanol group may be condensed while or after coating the particulate core material with the solvent including the resin and the catalyst to form the covering resin layer.

Specific examples of methods of condensing silanol group while coating the particulate core material with the solvent including the resin and the catalyst include, but are not limited to, methods of coating the particulate core material with the solvent including the resin and the catalyst while applying heat or light thereto. Specific examples of methods of condensing silanol group after coating the particulate core material with the solvent including the resin and the catalyst include, but are not limited to, methods of applying heat after coating the particulate core material with the solvent including the resin and the catalyst.

(Silane Coupling Agent)

The covering resin layer preferably includes a silane coupling agent further (0.001 to 30% by weight) in order to stabilize the carrier and improve durability thereof. The silane coupling agents are not particularly limited, and methyltrimethoxysilane, methyltriethoxysilane, octyltrimethoxysilane, etc. can be used. Aminosilane is preferably used.

Known aminosilane coupling agents can be used, e.g., compounds having the following formulae are preferably used.

$H_2N(CH_2)_3Si(OCH_3)_3$ having a molecular weight of 179.3

$H_2N(CH_2)_3Si(OC_2H_5)_3$ having a molecular weight of 221.4

$H_2N(CH_2)_3Si(CH_3)_2(OC_2H_5)$ having a molecular weight of 161.3

$H_2N(CH_2)_3Si(CH_3)(OC_2H_5)_2$ having a molecular weight of 191.3

$H_2N(CH_2)_2NHCH_2Si(OCH_3)_3$ having a molecular weight of 194.3

$H_2N(CH_2)_2NH(CH_2)_3Si(CH_3)_2(OCH_3)$ having a molecular weight of 206.4

$H_2N(CH_2)_2NH(CH_2)_3Si(OCH_3)_3$ having a molecular weight of 224.4

$(CH_3)_2N(CH_2)_3Si(CH_3)(OC_2H_5)_2$ having a molecular weight of 219.4

$(C_4H_9)_2NC_3H_6)_3Si(OCH_3)_3$ having a molecular weight of 291.6

The silane coupling agent may be included in a coated layer of the silicone resin in terms of controlling charge quantity of a toner in addition to covering the surface of the core material.

(Developer and Toner)

The carrier of the present invention is mixed with a toner to be used as a two-component developer.

The toner comprises a binder resin (e.g., a thermoplastic resin), a colorant, a charge controlling agent, a release agent, fine particles, etc. The toner may be obtained by various manufacturing methods such as polymerization methods and granulation methods, and have either an irregular or spherical shape. The toner may be either magnetic or non-magnetic. Specific examples of usable binder resins for the toner include, but are not limited to, styrene-based resins (e.g., homopolymers of styrene or styrene derivatives such as polystyrene and polyvinyl toluene; and styrene-based copolymers such as styrene-p-chlorostyrene copolymer, styrene-propylene copolymer, styrene-vinyltoluene copolymer, styrene-methyl acrylate copolymer, styrene-ethyl acrylate copolymer, styrene-butyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ether copolymer, styrene-vinyl methyl ketone copolymer, styrene-butadiene copolymer, styrene-isoprene copolymer, styrene-maleic acid copolymer, styrene-maleate copolymer), acrylic resins (e.g., polymethyl methacrylate, polybutyl methacrylate), polyvinyl chloride, polyvinyl acetate, polyethylene, polypropylene, polyester, polyurethane, epoxy resin, polyvinyl butyral, polyacrylic acid resin, rosin, modified rosin, terpene resin, phenol resin, aliphatic or alicyclic hydrocarbon resin, aromatic petroleum resin, chlorinated paraffin, and paraffin wax. Two or more of these resins can be used in combination.

Among these resins, polyester resins are preferable because they can have lower viscosity when melted while keeping better storage stability than styrene-based or acrylic resins.

The polyester resin can be obtained from a polycondensing reaction between an alcohol and a carboxylic acid.

Specific examples of suitable alcohols include, but are not limited to, diols (e.g., polyethylene glycol, diethylene glycol, triethylene glycol, 1,2-propylene glycol, 1,3-propylene glycol, 1,4-propylene glycol, neopentyl glycol, 1,4-butenediol), etherified bisphenols (e.g., 1,4-bis(hydroxymethyl)cyclohexane, bisphenol A, hydrogenated bisphenol A, polyoxyethylenated bisphenol A, polyoxypropylenated bisphenol A), divalent alcohols in which the above compounds are substituted with a saturated or unsaturated hydrocarbon group having 3 to 22 carbon atoms, other divalent alcohols, and tri- or more valent alcohols (e.g., sorbitol, 1,2,3,6-hexanetetrol, 1,4-sorbitan, pentaerythritol, dipentaerythritol, tripentaerythritol, sucrose, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene).

Specific examples of suitable carboxylic acids include, but are not limited to, monocarboxylic acids (e.g., palmitic acid, stearic acid, oleic acid), maleic acid, fumaric acid, mesaconic acid, citraconic acid, terephthalic acid, cyclohexane dicarboxylic acid, succinic acid, adipic acid, sebacic acid, malonic acid, divalent organic acids in which the above compounds are substituted with a saturated or unsaturated hydrocarbon group having 3 to 22 carbon atoms, anhydrides and lower esters of the above compounds, dimer acids of linoleic acid, and tri- or more valent carboxylic acids (e.g., 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl) methane, 1,2,7,8-octanetetracarboxylic acid enpol trimmer acid, and anhydrides of these compounds).

The epoxy resin can be obtained from polycondensing between bisphenol A and epichlorohydrin. Specific examples of commercially available epoxy resins include, but are not limited to, EPOMIK R362, R364, R365, R366, R367, and R369 (from Mitsui Chemicals, Inc.), EPOTOHTO YD-011, YD-012, YD-014, YD-904, and YD-017, (from Nippon Steel Chemical Co., Ltd.), and EPIKOTE 1002, 1004, and 1007 (from Shell Chemicals).

Specific examples of usable colorants include, but are not limited to, carbon black, lamp black, iron black, Ultramarine Blue, Nigrosine dyes, Aniline Blue, Phthalocyanine Blue, Hansa Yellow G, Rhodamine 6G Lake, Calco Oil Blue, Chrome Yellow, Quinacridone, Benzidine Yellow, Rose Bengal, triarylmethane dyes, monoazo and disazo dyes and pigments. Two or more of such colorants can be used in combination to obtain a desired color toner.

Black toner may include a magnetic material to be used as a magnetic toner. Specific examples of usable magnetic materials include, but are not limited to, powders of ferromagnetic materials (e.g., iron, cobalt), magnetite, hematite, Li ferrite, Mn—Zn ferrite, Cu—Zn ferrite, Ni—Zn ferrite, and Ba ferrite.

The toner may include a charge controlling agent to improve frictional chargeability. Specific examples of usable charge controlling agents include, but are not limited to, metal complex salts of monoazo dyes, nitrohumic acid and salts thereof, metal complex of salicylic acid, naphthoic acid, and dicarboxylic acid with Co, Cr, Ce, etc., amino compounds, quaternary ammonium compounds, and organic dyes.

Preferably, the toners having colors other than black include a white or a transparent material such as a white metal salt of a salicylic acid derivative.

The toner may include a release agent. Specific examples of usable release agents include, but are not limited to, low-molecular-weight polypropylene, low-molecular-weight polyethylene, carnauba wax, microcrystalline wax, jojoba wax, rice wax, montan wax. Two or more of these release agents can be used in combination.

The toner may externally include a fluidizer. The toner having proper fluidity produces high quality images. For example, fine particles of hydrophobized metal oxides, lubricants, metal oxides, organic resins, and metal salts may be externally added to the toner. Specific examples of suitable fluidizers include, but are not limited to, lubricants such as fluorocarbon resins (e.g., polytetrafluoroethylene) and zinc stearate; abrasive agents such cerium oxide and silicon carbide; inorganic oxides such as $SiO_2$ and $TiO_2$, the surfaces of which may be hydrophobized; caking preventing agents; and the above compounds of which surfaces are treated. Among various compounds, hydrophobized silica is preferable as a fluidizer.

The toner preferably has a weight average particle diameter of 3.0 to 9.0 μm, and more preferably 3.0 to 6.0 μm. Particle diameter of the toner can be measured by COULTER MULTISIZER II (from Beckman Coulter, Inc.).

The carrier may be used for a supplemental developer that is supplied to a developing device while a deteriorated developer is discharged therefrom. Because deteriorated carrier particles are replaced with fresh carrier particles included in the supplemental developer, toner particles are reliably charged and images are stably produced for an extended period of time.

The use of supplemental developer is effective when printing an image having a high area occupancy. When printing an image having a high area occupancy, carrier particles are deteriorated by adherence of toner particles while a large amount of supplemental carrier particles are supplied. Thus, the frequency of replacing deteriorated carrier particles with fresh carrier particles is increased and images are stably produced for an extended period of time.

The supplemental developer preferably includes a toner in an amount of 2 to 50 parts by weight, more preferably 5 to 12 parts by weight, based on 1 part by weight of the carrier. When the amount of toner is too small, toner particles may be excessively charged because an excessive amount of the carrier particles exist in a developing device. Because the excessively charged toner particles have poor developing power, the resulting image density may deteriorate. When the amount of toner is too large, the frequency of replacing deteriorated carrier particles with fresh carrier particles is reduced.

(Image Forming Method)

Exemplary embodiments of the present invention are described in detail below with reference to accompanying drawings. In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

FIG. 3 is a schematic view illustrating an embodiment of image developer of the image forming apparatus and image forming method of the present invention, and a modified example described below belongs thereto as well.

In FIG. 3, a developing device 40 is provided facing a photoreceptor 20 serving as an image bearing member. The developing device 40 includes a developing sleeve 41 serving as a developer bearing member, a developer container 42, a doctor blade 43 serving as a regulation member, and a support casing 44.

The support casing 44 has an opening on a side facing the photoreceptor 20. A toner hopper 45 serving as a toner container that contains toner particles 21 is attached to the support casing 44. A developer containing part 46 contains a developer comprising the toner particles 21 and carrier particles 23. A developer agitator 47 agitates the toner particles 21 and carrier particles 23 to frictionally charge the toner particles 21.

A toner agitator 48 and a toner supplying mechanism 49 each rotated by riving means, not shown, are provided in the toner hopper 45. The toner agitator 48 and the toner supplying mechanism 49 agitate and supply the toner particles 21 in the toner hopper 45 toward the developer containing part 46.

The developing sleeve 41 is provided within a space between the photoreceptor 20 and the toner hopper 45. The developing sleeve 41 is driven to rotate counterclockwise in FIG. 3 by a driving means, not shown. The developing sleeve 41 internally contains a magnet serving as a magnetic field generator. The relative position of the magnet to the developing device 40 remains unchanged.

The doctor blade 43 is integrally provided to the developer container 42 on the opposite side of the support casing 44. A constant gap is formed between the tip of the doctor blade 43 and the circumferential surface of the developing sleeve 41.

In a developing method according to exemplary aspects of the invention, the toner agitator 48 and the toner supplying mechanism 49 feed the toner particles 21 from the toner hopper 45 to the developer containing part 46. The developer agitator 47 agitates the toner particles 21 and the carrier particles 23 to frictionally charge the toner particles 21. The developing sleeve 41 bears the charged toner particles 21 and conveys them to a position where faces an outer peripheral surface of the photoreceptor 20 by rotation. The toner particles 21 then electrostatically bind to an electrostatic latent image formed on the photoreceptor 20. Thus, a toner image is formed on the photoreceptor 20.

FIG. 4 is a schematic view illustrating an embodiment of image forming apparatus of the present invention. Around a photoreceptor 20, a charging member 32, an irradiator 33, a developing device 40, a transfer member 50, a cleaning device 60, and a neutralization lamp 70 are provided. A surface of the charging member 32 forms a gap of about 0.2 mm with a surface of the photoreceptor 20. When an electric filed in which an alternating current component is overlapped with a direct current component is applied to the charging member 32 from a voltage applying mechanism, not shown, the photoreceptor 20 can be uniformly charged.

This image forming apparatus employs a negative-positive image forming process. The photoreceptor 20 having an organic photoconductive layer is neutralized by the neutralization lamp 70, and then negatively charged by the charging member 32. The charged photoreceptor 20 is irradiated with a laser light beam emitted from the irradiator 33 to form an electrostatic latent image thereon. In this embodiment, the absolute value of the potential of the irradiated portion is lower than that of the non-irradiated portion.

The laser light beam is emitted from a semiconductive laser. A polygon mirror that is a polygonal column rotating at a high speed scans the surface of the photoreceptor 20 with the laser light beam in the axial direction. The electrostatic latent image thus formed is then developed into a toner image with a developer supplied to a developing sleeve 41 in the developing device 40. When developing electrostatic latent image, a developing bias that is a predetermined voltage or that overlapped with an alternating current voltage is applied from a voltage applying mechanism, not shown, to between the developing sleeve 41 and the irradiated and non-irradiated portions on the photoreceptor 20.

On the other hand, a transfer medium 80 (e.g., paper, an intermediate transfer medium) is fed from a paper feed mechanism, not shown. A pair of registration rollers, not shown, feeds the transfer medium 80 to a gap between the photoreceptor 20 and the transfer member 50 in synchronization with an entry of the toner image to the gap so that the toner image is transferred onto the transfer medium 80. When transferring toner image, a transfer bias that is a voltage having the opposite polarity to the toner charge is applied to the transfer member 50. Thereafter, the transfer medium 80 separates from the photoreceptor 20.

Toner particles remaining on the photoreceptor 20 are removed by a cleaning blade 61 and collected in a toner collection chamber 62 in the cleaning device 60.

The collected toner particles may be referred to the developing device 40 by a recycle mechanism, not shown.

The image forming apparatus may include multiple developing devices. In this case, multiple toner images are sequentially transferred onto a transfer medium to form a composite toner image, and the composite toner image is finally fixed on the transfer medium. The image forming apparatus may further include and an intermediate transfer member. In this case, multiple toner images are transferred onto the intermediate transfer member to form a composite toner image, and the composite toner image is then transferred onto and fixed on a transfer medium.

FIG. 5 is a schematic view illustrating another embodiment of image forming apparatus executing the image forming method of the present invention. A photoreceptor 20 having a conductive substrate and a photosensitive layer is driven by driving rollers 24*a* and 24*b*. The photoreceptor 20 is repeatedly subjected to processes of charging by a charging member 32, irradiation by an irradiator, development by a developing device 40, transfer by a transfer member 50, pre-cleaning irradiation by a light source 26, cleaning by a cleaning brush 64 and a cleaning blade 61, and neutralization by a neutralization lamp 70. In the pre-cleaning irradiation process, light is emitted from the back side of the photoreceptor 20. Therefore, in this embodiment, the conductive substrate is translucent.

FIG. 6 is a schematic view illustrating an embodiment of process cartridge of the present invention. The process cartridge integrally supports a photoreceptor 20, a charging member 32, a developing device 40, and a cleaning blade 61. The process cartridge is detachable from image forming apparatuses.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

<Carrier Properties Evaluation>

[Areal Ratio of High-Brightness Contrast Part]

The areal ratio of the high-brightness contrast part on the surface was determined from a reflection electron image taken by Carl Zeiss Schottky Fe-SEM ULTRA55 from Carl Zeiss, which was subjected to an image process with an image process software Image Pro Plus Ver5.0.1 from Media Cybernetics, Inc.

Imaging conditions and image processing conditions are shown in Tables 1 and 2.

[Weight-Average Particle Diameter of Particulate Core Material]

In the present invention, the particle diameter distribution was measured by a Microtrac particle size analyzer (HRA9320-X100 from Honeywell International Inc.) under the following measurement conditions.

Particle diameter range: 100 to 8 μm

Channel width: 2 μm

Number of channels: 46

Refractive index: 2.42

[Average Thickness of Carrier Covering Resin Layer]

The thickness of the covering resin layer h was measured by observing a cross-section of the carrier with a transmission electron microscope (TEM (about) 2.000-fold magnification) to determine an average thickness. Specifically, distances from random 50 points on the surface of the core material to the surface of the covering resin layer were measured and an average thereof was determined as the thickness h (μm).

<Electroconductive Particulate Material Preparation Example>

(Electroconductive Particulate Material Preparation Example 1)

A suspension was prepared by dispersing 100 g of aluminum oxide having an average primary particle diameter of 0.3 μm (AKP-30 from Sumitomo Chemical Co., Ltd.) in 1 liter of water, followed by heating at 70° C. A solution in which 100 g of tin tetrachloride and 3 g of phosphorus pentoxide were dissolved in 1 liter of 2N hydrochloric acid and a 12% ammonia water were dropped in the suspension over a period of 2 hours so that pH of the suspension becomes 7 to 8. The suspension was then filtered and washed to obtain a cake. The cake was dried at 110° C. The resulting dried powder was treated at 500° C. for 1 hour under nitrogen gas flow. Thus, an electroconductive particulate material 1 including tin dioxide in an amount of 37% by weight was prepared.

(Electroconductive Particulate Material Preparation Example 2)

A suspension was prepared by dispersing 100 g of aluminum oxide having an average primary particle diameter of 0.15 μm (HIT-70 from Sumitomo Chemical Co., Ltd.) in 1 liter of water, followed by heating at 70° C. A solution in which 100 g of tin tetrachloride and 3 g of phosphorus pentoxide were dissolved in 1 liter of 2N hydrochloric acid and a 12% ammonia water were dropped in the suspension over a period of 2 hours so that pH of the suspension becomes 7 to 8. The suspension was then filtered and washed to obtain a cake. The cake was dried at 110° C. The resulting dried powder was treated at 500° C. for 1 hour under nitrogen gas flow. Thus, an electroconductive particulate material 2 including tin dioxide in an amount of 37% by weight was prepared.

(Electroconductive Particulate Material Preparation Example 3)

A suspension was prepared by dispersing 100 g of aluminum oxide having an average primary particle diameter of 0.5 μm (AKP-20 from Sumitomo Chemical Co., Ltd.) in 1 liter of water, followed by heating at 70° C. A solution in which 100 g of tin tetrachloride and 3 g of phosphorus pentoxide were dissolved in 1 liter of 2N hydrochloric acid and a 12% ammonia water were dropped in the suspension over a period of 2 hours so that pH of the suspension becomes 7 to 8. The suspension was then filtered and washed to obtain a cake. The cake was dried at 110° C. The resulting dried powder was treated at 500° C. for 1 hour under nitrogen gas flow. Thus, an electroconductive particulate material 3 including tin dioxide in an amount of 37% by weight was prepared.

(Electroconductive Particulate Material Preparation Example 4)

One lot of 100 g of aluminum oxide having an average primary particle diameter of 0.3 μm (AKP-30 from Sumitomo Chemical Co., Ltd.) was an electroconductive particulate material 4 excluding tin dioxide, i.e., including tin dioxide in an amount of 0% by weight. (Electroconductive Particulate Material Preparation Example 5)

A suspension was prepared by dispersing 100 g of aluminum oxide having an average primary particle diameter of 0.2 μm (DEGUSSA AEROXIDE AluC) in 1 liter of water, followed by heating at 70° C. A solution in which 100 g of tin tetrachloride and 3 g of phosphorus pentoxide were dissolved in 1 liter of 2N hydrochloric acid and a 12% ammonia water were dropped in the suspension over a period of 2 hours so that pH of the suspension becomes 7 to 8. The suspension was then filtered and washed to obtain a cake. The cake was dried at 110° C. The resulting dried powder was treated at 500° C. for 1 hour under nitrogen gas flow. Thus, an electroconductive particulate material 5 including tin dioxide in an amount of 37% by weight was prepared.

<Core Material Preparation Example>

(Core Material Preparation Example 1)

A mixture of $MnCO_3$, $Mg(OH)_2$, $Fe_2O_3$ and $SrCO_3$ was pre-burnt at 900° C. for 3 hours in the atmosphere using a heating oven, followed by cooling and pulverization to prepare a powder having a diameter about 1 μm.

Water and a dispersant in an amount of 1% by weight were added to the powder to prepare a slurry, and the slurry was fed to a spray dryer to prepare a granulated material having an average particle diameter of 40 μm.

The granulated material was placed in a firing furnace and burnt at 1350° C. for 5 hrs under a nitrogen atmosphere. The burnt material was pulverized by a pulverizer and classified with a sieve to prepare a spherical particulate ferrite having a volume-average particle diameter about 35 μm and including the following components.

| | |
|---|---|
| MnO | 46.2% by mol |
| MgO | 0.7% by mol |
| $Fe_2O_3$ | 53% by mol |

The spherical particulate ferrite had an Ra of 0.38 μm and a bulk density of 2.5 g/cm$^3$.

The bulk density was measured by dropping the spherical particulate ferrite from a funnel having an orifice diameter of 3 mm at a height of 35 mm into a container having a capacity of 25 cm$^3$.

(Core Material Preparation Example 2)

The procedure for preparation of the core material in core material preparation example 1 was repeated except for the granulated material was burnt at 1300° C. for 5 hrs under a nitrogen atmosphere.

The spherical particulate ferrite had an Ra of 0.4 μm and a bulk density of 2.4 g/cm$^3$.

(Core Material Preparation Example 3)

The procedure for preparation of the core material in core material preparation example 1 was repeated except for the granulated material was burnt at 1250° C. for 5 hrs under a nitrogen atmosphere.

The spherical particulate ferrite had an Ra of 0.45 μm and a bulk density of 2.4 g/cm$^3$.

(Core Material Preparation Example 4)

The procedure for preparation of the core material in core material preparation example 1 was repeated except for the granulated material was burnt at 1500° C. for 5 hrs under a nitrogen atmosphere.

The spherical particulate ferrite had an Ra of 0.28 μm and a bulk density of 2.6 g/cm$^3$.

(Core Material Preparation Example 5)

The procedure for preparation of the core material in core material preparation example 1 was repeated except for the granulated material was burnt at 1400° C. for 5 hrs under a nitrogen atmosphere.

The spherical particulate ferrite had an Ra of 0.32 μm and a bulk density of 2.6 g/cm$^3$.

<Carrier Preparation Example>

Carrier Preparation Examples 1 to 9, 12 and 13 are Examples of the present invention, and Carrier Preparation Examples 10 and 11 are Comparative Examples.

The areal ratios of the high-brightness contrast part to the total area of the carriers are shown in Table 3-1.

(Carrier Preparation Example 1)

On the core material prepared in Core Material Preparation Example 1, a covering layer solution including a solid content in an amount of 10% by weight in which 205 parts of a silicone resin (SR2411 having a solid content in an amount of 20% by weight from Toray Dow Corning Silicone Co., Ltd.), 58 parts of the electroconductive particulate material prepared in Electroconductive Particulate Material Preparation Example 1 and one part of zirconiumtetraacetylacetonate as a catalyst were diluted in toluene was coated by a fluidized-bed coater such that the coated film has an average thickness of 0.3 μm at 70° C., and dried to prepare a crude carrier. The crude carrier was burnt at 230° C. for 2 hrs to prepare a carrier. The covering layer included the electroconductive particulate material in an amount of 58% by weight and had a resistivity of 8.0 Ωcm.

(Carrier Preparation Example 2)

On the core material prepared in Core Material Preparation Example 1, a covering layer solution including a solid content in an amount of 10% by weight in which 130 parts of a silicone resin (SR2411 having a solid content in an amount of 20% by weight from Toray Dow Corning Silicone Co., Ltd.), 73 parts of the electroconductive particulate material prepared in Electroconductive Particulate Material Preparation Example 1 and one part of zirconiumtetraacetylacetonate as a catalyst were diluted in toluene was coated by a fluidized-bed coater such that the coated film has an average thickness of 0.3 μm at 70° C., and dried to prepare a crude carrier. The crude carrier was burnt at 230° C. for 2 hrs to prepare a carrier. The covering layer included the electroconductive particulate material in an amount of 73% by weight and had a resistivity of 6.9 Ωm.

(Carrier Preparation Example 3)

The procedure for preparation of the carrier in Carrier Preparation Example 1 was repeated except for replacing the core material prepared in Core Material Preparation Example 1 with the core material prepared in Core Material Preparation Example 2. The covering layer included the electroconductive particulate material in an amount of 58% by weight and had a resistivity of 8.1 Ωm.

(Carrier Preparation Example 4)

The procedure for preparation of the carrier in Carrier Preparation Example 1 was repeated except for replacing the core material prepared in Core Material Preparation Example 1 with the core material prepared in Core Material Preparation Example 5, and the electroconductive particulate material prepared in Electroconductive Particulate Material Preparation Example 1 with the electroconductive particulate material prepared in Electroconductive Particulate Material Preparation Example 2. The covering layer included the electroconductive particulate material in an amount of 58% by weight and had a resistivity of 7.8 Ωm.

(Carrier Preparation Example 5)

The procedure for preparation of the carrier in Carrier Preparation Example 1 was repeated except for replacing the core material prepared in Core Material Preparation Example 1 with the core material prepared in Core Material Preparation Example 5, and the electroconductive particulate material prepared in Electroconductive Particulate Material Preparation Example 1 with the electroconductive particulate material prepared in Electroconductive Particulate Material Preparation Example 3. The covering layer included the electroconductive particulate material in an amount of 58% by weight and had a resistivity of 8.3 Ωcm.

(Carrier Preparation Example 6)

The procedure for preparation of the carrier in Carrier Preparation Example 1 was repeated except for replacing the core material prepared in Core Material Preparation Example 1 with the core material prepared in Core Material Preparation Example 5, and the electroconductive particulate material prepared in Electroconductive Particulate Material Preparation Example 1 with the electroconductive particulate material prepared in Electroconductive Particulate Material Preparation Example 4. The covering layer included the electroconductive particulate material in an amount of 58% by weight and had a resistivity of 7.2 Ωcm.

(Carrier Preparation Example 7)

The procedure for preparation of the carrier in Carrier Preparation Example 1 was repeated except for replacing the core material prepared in Core Material Preparation Example 1 with the core material prepared in Core Material Preparation Example 5, and changing the average thickness of the coated film from 0.3 to 0.5 μm. The covering layer included the electroconductive particulate material in an amount of 58% by weight and had a resistivity of 8.4 Ωcm.

(Carrier Preparation Example 8)

The procedure for preparation of the carrier in Carrier Preparation Example 1 was repeated except for replacing the core material prepared in Core Material Preparation Example 1 with the core material prepared in Core Material Preparation Example 5, and changing the average thickness of the coated film from 0.3 to 0.2 μm. The covering layer included the electroconductive particulate material in an amount of 58% by weight and had a resistivity of 6.6 Ωcm.

(Carrier Preparation Example 9)

The procedure for preparation of the carrier in Carrier Preparation Example 1 was repeated except for replacing the core material prepared in Core Material Preparation Example 1 with the core material prepared in Core Material Preparation Example 5, and changing the average thickness of the coated film from 0.3 to 0.6 μm. The covering layer included the electroconductive particulate material in an amount of 58% by weight and had a resistivity of 8.6 Ωcm.

(Carrier Preparation Example 10)

On the core material prepared in Core Material Preparation Example 5, a covering layer solution including a solid content in an amount of 10% by weight in which 245 parts of a silicone resin (SR2411 having a solid content in an amount of 20% by weight from Toray Dow Corning Silicone Co., Ltd.), 50 parts of the electroconductive particulate material prepared in Electroconductive Particulate Material Preparation Example 1 and one part of zirconiumtetraacetylacetonate as a catalyst were diluted in toluene was coated by a fluidized-bed coater such that the coated film has an average thickness of 0.3 μm at 70° C., and dried to prepare a crude carrier. The crude carrier was burnt at 230° C. for 2 hrs to prepare a carrier. The covering layer included the electroconductive particulate material in an amount of 50% by weight and had a resistivity of 9.2 Ωcm.

(Carrier Preparation Example 11)

On the core material prepared in Core Material Preparation Example 5, a covering layer solution including a solid content in an amount of 10% by weight in which 95 parts of a silicone resin (SR2411 having a solid content in an amount of 20% by weight from Toray Dow Corning Silicone Co., Ltd.), 80 parts of the electroconductive particulate material prepared in Electroconductive Particulate Material Preparation Example 1 and one part of zirconiumtetraacetylacetonate as a catalyst were diluted in toluene was coated by a fluidized-bed coater such that the coated film has an average thickness of 0.3 μm at 70° C., and dried to prepare a crude carrier. The crude carrier was burnt at 230° C. for 2 hrs to prepare a carrier. The covering layer included the electroconductive particulate material in an amount of 80% by weight and had a resistivity of 6.0 Ωcm.

(Carrier Preparation Example 12)

On the core material prepared in Core Material Preparation Example 3, a covering layer solution including a solid content in an amount of 10% by weight in which 155 parts of a silicone resin (SR2411 having a solid content in an amount of 20% by weight from Toray Dow Corning Silicone Co., Ltd.), 68 parts of the electroconductive particulate material prepared in Electroconductive Particulate Material Preparation Example 1 and one part of zirconiumtetraacetylacetonate as a catalyst were diluted in toluene was coated by a fluidized-bed coater such that the coated film has an average thickness of 0.3 μm at 70° C., and dried to prepare a crude carrier. The crude carrier was burnt at 230° C. for 2 hrs to prepare a carrier. The covering layer included the electroconductive particulate material in an amount of 68% by weight and had a resistivity of 7.2 Ωcm.

(Carrier Preparation Example 13)

The procedure for preparation of the carrier in Carrier Preparation Example 12 was repeated except for replacing the core material prepared in Core Material Preparation Example 3 with the core material prepared in Core Material Preparation Example 4. The covering layer included the electroconductive particulate material in an amount of 68% by weight and had a resistivity of 7.2 Ωcm.

(Carrier Preparation Example 14)

The procedure for preparation of the carrier in Carrier Preparation Example 1 was repeated except for replacing the electroconductive particulate material prepared in Electroconductive Particulate Material Preparation Example 1 with the electroconductive particulate material prepared in Electroconductive Particulate Material Preparation Example 5. The covering layer included the electroconductive particulate material in an amount of 58% by weight and had a resistivity of 6.0 Ωcm.

(Carrier Preparation Example 15)

The procedure for preparation of the carrier in Carrier Preparation Example 1 was repeated except for replacing 205 parts of the silicone resin (SR2411 having a solid content in an amount of 20% by weight from Toray Dow Corning Silicone Co., Ltd.) with 164 parts of a methacrylic copolymer resin including a solid content of 25% by weight, prepared in the following Resin Synthesis Example 1. The covering layer included the electroconductive particulate material in an amount of 58% by weight and had a resistivity of 8.0 Ωcm.

(Resin Synthesis Example 1)

Three hundred (300) g of toluene were placed in a flask including a stirrer, and heated to have a temperature of 90° C. under nitrogen stream. Next, a mixture of 84.4 g (200 mmol) of 3-methacryloxypropyltris(trimethylsiloxy)silane having a formula of $CH_2{=}CMe\text{-}COO{-}C_3H_6{-}Si(OSiMe_3)_3$ (Me is a methyl group) Silaplane TM-0701T (manufactured by Chisso Corporation), 39 g (150 mmol) of 3-methacryloxypropyltrimethoxysilane, 65.0 g (650 mmol) of methylmethacrylate and 0.58 g (3 mmol) of 2,2'-azobis-2-methylbutyronitrile was dropped therein for 1 hour. Further, a solution in which 0.06 g (0.3 mmol) of 2,2'-azobis-2-methylbutyronitrile was dissolved in 15 g of toluene was added, then, mixed at 90 to 100° C. for 3 hours such that radical copolymerization is performed to prepare a methacrylic copolymer 1.

The methacrylic copolymer 1 had a weight-average molecular weight of 34,000. A solution of the methacrylic copolymer 1 was diluted with toluene to have a nonvolatile component of 25% by weight. The copolymer solution had a viscosity of 8.7 $mm^2$/sec and a specific gravity of 0.91.

The weight-average molecular weight was determined from standard polyester conversion using gel permeation chromatography. The viscosity was measured according to JIS-K-2283.

The nonvolatile component was determined by the following formula, weighing 1 g of the coating composition on an aluminum plate and heating the composition at 150° C. for 1 hr.

Nonvolatile component (%)=(weight before heated−weight after heated)×100/weight before heated <Toner Preparation Example>

The following materials were fully mixed by a HENSCHEL MIXER to prepare a mixture, and the mixture was kneaded upon application of heat by a biaxial extruder to prepare a kneaded mixture.

| | |
|---|---|
| Polyester resin [having a weight-average molecular weight (Mw) of 18,000, a number-average molecular weight (Mn) of 4,000, a glass transition temperature (Tg) of 59° C. and a softening point of 120° C.] | 100 |
| Carnauba wax | 5 |
| Carbon black (#44 from Mitsubishi Chemical Corp.) | 10 |
| Fluorine-containing quaternary ammonium salt | 4 |

The kneaded mixture was extended with pressure and cooled, and crushed by a cutter mill to prepare a crushed material, the crushed material was pulverized by a jet stream pulverizer to prepare a pulverized material and the pulverized material was classified by a wind force classifier to prepare mother toner particles having an weight-average particle diameter of 7.4 μm.

Further, 1.0 parts of a particulate hydrophobic silica (R972 from Nippon Aerosil Co., Ltd.) and 100 parts of the mother toner particles were mixed by a HENSCHEL mixer to prepare a toner 1.

<Preparation of Developer>

Ninety three (93) parts of each of the carriers prepared in Carrier Preparation Examples and 7 parts of toner 1 were stirred by a ball mill to prepare developers of Examples and Comparative Examples.

Examples and Comparative Examples

After initial images were produced with developers of Examples and Comparative Examples, each of the developers was set in Imagio Color 4000 and stirred for 10 min at a monochromatic mode. Then, after 100,000 pieces of an image having an image area of 7% were produced, image density, high light image density, image granularity, background fouling, carrier adherence, image density variation in environments and toner scattering were evaluated.

In Tables 3-1 and 3-2, the Carrier Preparation Example Nos., the Electroconductive Particulate Material Preparation Example Nos. and the Core Material Preparation Example Nos. are shown.

The areal ratios of the high-brightness contrast part to the total area of the carriers in FE-SEM reflection electron images thereof are shown in Table 3-1.

In Example 11, a developer including 90 parts of toner 1 and 10 parts of the carrier prepared in Carrier Preparation Example 1 was used.

(Quality Evaluation)

Image quality and reliability were evaluated by a digital color copier/printer complex machine imagio color 4000 from Ricoh Company, Ltd. under the following conditions.

Developing gap (photoreceptor-developing sleeve): 0.3 mm

Doctor gap (developing sleeve doctor): 0.65 mm

Photoreceptor linear speed: 200 mm/sec (Developing sleeve liner speed)/(Photoreceptor linear speed): 1.80

Writing density: 600 dpi

Charged potential (Vd): −600 V

Potential of solid image part after irradiated: −100 V

Developing bias: DC −500 V/AC bias component: 2 KHz, −100 V to −900 V, 50% duty

The image quality on a transfer paper was evaluated, and the carrier adherence after developed was transferred onto an adhesive tape before transferred and observed.

[Variation of Amount of Developer Drawn]

Variation of amount of developer drawn(%)={(initial amount of developer drawn−amount of developer drawn after production of 100,000 images)/initial amount of developer drawn}×100

±less than 5%: Excellent

±not less than 5% and ±less than 10%: Good

±not less than 10% and ±less than 20%: Fair

±not less than 20%: Poor

[Adhesiveness to Toner]

Each 6 g of the initial developer and the developer after production of 100,000 images was placed in a conductive container (cage) having metallic (stainless) meshes at both ends. The mesh had an opening of 20 μm which is an intermediate between particle diameters of the toner and the carrier such that the toner passes the mesh. Compressed nitrogen gas was sprayed from a nozzle (1 kgf/cm$^2$) for 60 sec to fly the toner out of the cage and leave the carrier having a polarity reverse to that of the toner therein. The toner component of the carrier left in the cage was extracted with methyl ethyl ketone to determine a difference (% by weight to the weight of the carrier).

0 to less than 0.03% by weight: Excellent 0.03 to less than 0.07% by weight: Good 0.07 to less than 0.15% by weight: Fair Not less than 0.15% by weight: Poor

[Peeling of Carrier Covering Resin Layer]

Six (6) g of the developer after production of 100,000 images was placed in a conductive container (cage) having metallic (stainless) meshes at both ends. The mesh had an opening of 20 μm which is an intermediate between particle diameters of the toner and the carrier such that the toner passes the mesh. Compressed nitrogen gas was sprayed from a nozzle (1 kgf/cm$^2$) for 60 sec to fly the toner out of the cage and leave the carrier having a polarity reverse to that of the toner therein. Cross-sections of 10 of the carriers left therein were observed (2000-fold magnification) to evaluate presence of peeling of the carrier covering resin layer (=exposed part of the core material).

No peeling of the carrier covering resin layer (=exposed part of the core material) is observed: Excellent One (1) to less than 5 peeling of the carrier covering resin layer (=exposed part of the core material) are observed: Good Five (5) to less than 10 peeling of the carrier covering resin layer (=exposed part of the core material) are observed: Fair Not less than 10 peeling of the carrier covering resin layer (=exposed part of the core material) are observed: Poor

[Specific Volume Resistivity of Carrier]

Each 6 g of the initial developer and the developer after production of 100,000 images was placed in a conductive container (cage) having metallic (stainless) meshes at both ends. The mesh had an opening of 20 μm which is an intermediate between particle diameters of the toner and the carrier such that the toner passes the mesh. Compressed nitrogen gas was sprayed from a nozzle (1 kgf/cm$^2$) for 60 sec to fly the toner out of the cage and leave the carrier having a polarity reverse to that of the toner therein. The specific volume resistivity of the carrier therein was measured.

The specific volume resistivity was measured with a cell 11 in FIG. 7. Specifically, the cell formed of a fluorocarbon-resin container, in which electrodes 12*a* and 12*b* each having a surface area of 2.5 cm×4 cm are facing at a distance of 0.2 cm, was filled with the carrier. The cell filled with the carrier is tapped from a height of 1 cm for 10 times at a tapping speed of 30 times/min. Thereafter, a direct current voltage of 1,000 V is applied to between the electrodes 12*a* and 12*b* for 30 seconds to measure a resistance r (Ω) by a high resistance meter 4329A (from Hewlett-Packard Japan, Ltd.). Then, from the following formula, Log R Ωcm was calculated.

$$R=r\times(2.5\times4)/0.2$$

A difference of Log R between the carriers extracted from the initial developer and the developer after production of 100,000 images was evaluated.

Less than 0.5: Excellent 0.5 to less than 1: Good 1 to less than 2: Fair

Not less than 2: Poor (Image Quality Evaluation)

[Image Density]

An average of five points of the center of a solid image (developing potential is 400 V=(irradiated part potential−developing bias DC)=−100 V−(−500V)) having an area of 30 mm×30 mm measured by a densitometer X-Rite 938.

Not less than 1.55: Excellent (Initial image density)

1.50 to less than 1.55: Good 1.45 to less than 1.50: Fair

Less than 1.45: Poor

[Background Fouling]

Visually observed.

[Carrier Adherence (on Solid Mage)]

Carrier adherence causes damages of the photoreceptor drum and the fixing roller, resulting in deterioration of image quality. Even when the carrier adheres to the photoreceptor, only a part of the carrier is transferred onto a paper. Therefore, after a solid image having an area of 30 mm×30 mm was produced by imagio color 4000 at a charged potential (Vd) of −600 V, a potential of solid image part after irradiated of −100 V and a developing bias of DC −500V, the carrier on the photoreceptor was counted.

[Ghost Image Evaluation]

Each of the developers was set in a marketed digital full-color printer RICOH Pro C901 from Ricoh Company, Ltd. After 100,000 images of a letter chart (2 mm×2 mm/letter) having an image area ratio of 8% were produced, a vertical band chart in FIG. 8 was printed to measure a difference of density between one cycle (a) and after one cycle (b) of sleeve and by X-Rite 938 from X-Rite, Inc. An average density among the center, rear and front was ΔID.

0.01≥ΔID: Excellent 0.01<ΔID≤0.03: Good 0.03<ΔID≤0.06: Fair=acceptable 0.06<ΔID: Poor=unusable

TABLE 3-1

| | Preparation Example | | | | | |
|---|---|---|---|---|---|---|
| | (1) | (2) | (3) | (4) | (5) | (6) |
| Example 1 | 1 | 1 | 1 | 1 | 0.65 | 55 |
| Example 2 | 1 | 1 | 2 | 2 | 0.90 | 80 |
| Example 3 | 1 | 2 | 3 | 3 | 0.75 | 65 |
| Example 4 | 2 | 5 | 4 | 4 | 0.60 | 50 |
| Example 5 | 3 | 5 | 5 | 5 | 0.60 | 50 |
| Example 6 | 4 | 5 | 6 | 6 | 0.75 | 65 |
| Example 7 | 1 | 5 | 7 | 7 | 0.55 | 45 |
| Example 8 | 1 | 5 | 8 | 8 | 0.70 | 60 |
| Example 9 | 1 | 5 | 9 | 9 | 0.50 | 40 |
| Example 10 | 1 | 1 | 15 | 15 | 0.75 | 65 |
| Example 11 | 1 | 1 | 1 | 1 | 0.65 | 55 |
| Comparative Example 1 | 1 | 1 | 10 | 10 | 0.40 | 30 |
| Comparative Example 2 | 1 | 1 | 11 | 11 | 1.05 | 95 |
| Example 12 | 1 | 3 | 12 | 12 | 0.50 | 40 |
| Example 13 | 1 | 4 | 13 | 13 | 0.65 | 55 |
| Comparative Example 3 | 5 | 1 | 14 | 14 | 0.45 | 35 |

(1): Electroconductive Particulate Material Preparation Example (2): Core Material Preparation Example (3): Carrier Preparation Example (4): Developer Preparation Example (5): Areal ratio of high-brightness contrast part to whole area of carrier at an acceleration voltage of 0.8 kV (6): Areal ratio of high-brightness contrast part to whole area of carrier at an acceleration voltage of 2.0 kV

Having now fully described the invention, it will be apparent to one of ordinary skill in the art that many changes and modifications can be made thereto without departing from the spirit and scope of the invention as set forth therein.

What is claimed is:

1. A carrier for developing electrostatic latent images, comprising:

a core material having a surface roughness of from 0.3 to 0.4 μm; and a covering layer formed of a resin comprising an electroconductive particulate material, overlying the core material, wherein the electroconductive particulate material comprises a substrate comprising alumina; and an electroconductive covering layer comprising tin dioxide, overlying the substrate;

wherein the covering layer comprises the electroconductive particulate material in an amount of from 58 to 73% by weight and has a resistivity of from 6.6 to 8.6 Ωcm, and wherein the carrier has a high-brightness contrast part at an areal ratio less than 1% and 40 to 90% based on total area thereof at an acceleration voltage of 0.8 KV and 2.0 KV, respectively in an FE-SEM reflection electron image of the surface thereof.

2. The carrier of claim 1, wherein the electroconductive particulate material has an average primary particle diameter of from 0.15 to 0.5 μm.

3. The carrier of claim 1, wherein the resin comprising the electroconductive particulate material is a silicone resin.

4. The carrier of claim 1, wherein the covering layer excluding the electroconductive particulate material has an average thickness of from 0.3 to 0.5 μm.

TABLE 3-2

| | Evaluation Result | | | | | | | |
|---|---|---|---|---|---|---|---|---|
| | Carrier | | | | Image Quality | | | |
| | (A) | (B) | (C) | (D) | (E) | (F) | (G) | (H) |
| Example 1 | Good | Fair | Good | Good | Good | Good | Good | Good |
| Example 2 | Good | Fair | Good | Good | Good | Good | Good | Excellent |
| Example 3 | Good | Fair | Good | Good | Good | Good | Good | Excellent |
| Example 4 | Good | Fair | Good | Good | Fair | Good | Good | Good |
| Example 5 | Good | Fair | Good | Good | Good | Good | Good | Good |
| Example 6 | Good | Fair | Good | Good | Fair | Good | Good | Good |
| Example 7 | Good | Fair | Good | Good | Good | Good | Good | Good |
| Example 8 | Good | Fair | Good | Good | Fair | Good | Good | Fair |
| Example 9 | Good | Fair | Fair | Good | Good | Fair | Fair | Fair |
| Example 10 | Good | Good | Good | Good | Good | Good | Good | Good |
| Example 11 | Excellent | Excellent | Excellent | Excellent | Excellent | Excellent | Excellent | Excellent |
| Comparative Example 1 | Poor | Poor | Fair | Poor | Good | Fair | Fair | Poor |
| Comparative Example 2 | Good | Fair | Poor | Poor | Poor | Poor | Poor | Poor |
| Example 12 | Fair | Fair | Fair | Fair | Good | Fair | Fair | Fair |
| Example 13 | Good | Good | Fair | Fair | Good | Fair | Fair | Fair |
| Comparative Example 3 | Poor | Poor | Poor | Poor | Poor | Poor | Poor | Fair |

(A): Resistivity (B): Film Peeling (C): Adhesiveness to Toner (D): Amount Drawn (E): Carrier Adherence (F): Background Fouling (G): Image Density (H): Ghost Phenomenon

5. The carrier of claim 1, wherein the resin comprising the electroconductive particulate material comprises a resin obtained by heating a copolymer comprising an A component having the following formula (I) and a B component having the following formula (II):

(I)

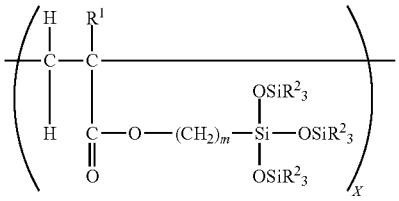

-continued (II)

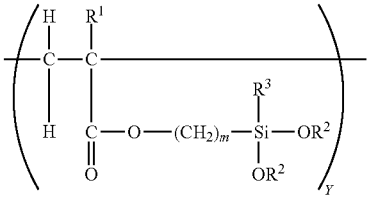

wherein $R^1$ represents a hydrogen atom or a methyl group; m represents an integer of from 1 to 8; $R^2$ represents an alkyl group having 1 to 4 carbon atoms; $R^3$ represents an alkyl group having 1 to 8 carbon atoms or alkoxy groups having 1 to 4 carbon atoms; and X and Y are 10 to 90% by mol.

6. The carrier of claim 1, wherein the core material has a weight-average particle diameter of from 20 to 50 μm.

7. A developer for developing electrostatic latent images, comprising a toner and the carrier according to claim 1.

8. The developer of claim 7, wherein the toner is a color toner.

* * * * *